US010896630B2

(12) United States Patent
Boswell

(10) Patent No.: US 10,896,630 B2
(45) Date of Patent: Jan. 19, 2021

(54) RAPIDLY-DEPLOYABLE CONFIGURABLE, MODULAR LIGHT EMITTING DIODE (LED) SIGN SYSTEM

(71) Applicant: Ronnie R. Boswell, Muskogee, OK (US)

(72) Inventor: Ronnie R. Boswell, Muskogee, OK (US)

( * ) Notice: Subject to any disclaimer, the term of this patent is extended or adjusted under 35 U.S.C. 154(b) by 241 days.

(21) Appl. No.: 15/964,854

(22) Filed: Apr. 27, 2018

(65) Prior Publication Data

US 2019/0333426 A1 Oct. 31, 2019

(51) Int. Cl.

| | |
|---|---|
| ***G09F 9/302*** | (2006.01) |
| ***G09F 9/33*** | (2006.01) |
| ***G09F 5/00*** | (2006.01) |
| ***G09G 5/00*** | (2006.01) |

(52) U.S. Cl.

CPC ..... *G09F 9/3026* (2013.01); *G09F 9/33* (2013.01); *G09G 5/006* (2013.01); *G09G 2370/16* (2013.01); *G09G 2380/06* (2013.01)

(58) Field of Classification Search

CPC ..... G09F 9/3026; G09F 9/33; G09G 5/006; G09G 2370/16; G09G 2380/06

See application file for complete search history.

(56) References Cited

U.S. PATENT DOCUMENTS

| | | | | |
|---|---|---|---|---|
| 5,995,179 | A * | 11/1999 | Tamura | G09F 9/3026 349/58 |
| 9,415,922 | B1 * | 8/2016 | Park | B65D 81/051 |
| 2003/0064624 | A1 * | 4/2003 | Rus | H01R 13/5224 439/537 |
| 2009/0309819 | A1 * | 12/2009 | Elliott | F21V 21/088 345/82 |
| 2011/0146119 | A1 * | 6/2011 | Wagner | G09F 13/22 40/452 |
| 2016/0224306 | A1 * | 8/2016 | Rycyna, III | G06F 3/1446 |
| 2017/0053570 | A1 * | 2/2017 | Cox | G09F 19/228 |

* cited by examiner

*Primary Examiner* — Brent D Castiaux
(74) *Attorney, Agent, or Firm* — Edward L. White

(57) ABSTRACT

A rapidly-deployable, configurable, modular light emitting diode sign system comprising a modular rigid cabinet with a cavity therein receiving system components where each cabinet has a front opening with releasable fasteners, a lock, and cable channels. A light emitting diode panel covering the front opening and receiving communication from the controller regarding messages to be displayed. A shipping package system having a box and shock absorbers sized to receive a display to snugly fit inside the box protecting the display from damage during shipment whereby each cabinet with needed components are shipped in the same box so that an installer desiring to create a sign of a specified size by mulling together a number of cabinets, receives the needed number of boxed cabinets, assembles them using the shipped equipment, with minimal tools or additional parts, and without the need to modify the displays onsite to mull them together.

20 Claims, 16 Drawing Sheets

Front View

RAPIDLY-DEPLOYABLE CONFIGURABLE, MODULAR LIGHT EMITTING DIODE (LED) SIGN SYSTEM

CROSS-REFERENCE TO RELATED APPLICATIONS

Applicants claim benefit pursuant to 35 U.S.C. § 119 and hereby incorporate by reference a provisional patent application for "LED Modular Display System", Application 62/491,092, filed Apr. 27, 2017.

FIELD OF THE INVENTION

The invention generally relates to rapidly-deployable configurable LED sign through the fabrication, packaging, delivery, assembly, and installation of LED signs for displaying desired video images. In particular, the invention relates to a system for the rapid deployment, assembly, and installation of a plurality of interlocking and aligning LED sign cabinet sections to create a rigid monolithic LED sign of desired size where the LED sign cabinets sections are securely packaged and stored, shipped to a desired location upon request, assembled into the desired sign size with interconnecting power and data cables between the multiple section protected from the environment and rigid external structure maintaining the integrity of the assembled monolithic modular sign.

BACKGROUND

LED signs are very popular for advertising both inside and outside of buildings. To be competitive in an ever-changing economy, businesses must be able to be rapidly adapt to the environment through advertising. One of the most popular methods for advertising is the use of LED signs, but the current systems take weeks to assemble, install, and make operational. However, once a customer purchases an LED sign to advertise or perform other activities, they expect the sign to be installed within a short time period and installation weeks later is unacceptable. The current process for the fabrication, shipping, assembly, installation and operation of LED sign systems includes welders fabricating a rigid structure to receive a plurality of LED modules stacked side-by-side and above and below, and electricians wiring the sign system for power and data. Additionally, once the LED sign system is assembled and installed, a technician programs the system controller to display the customer's messages, and trains customer personnel on the programming. This process takes in excess of 10 weeks. Current types of LED sign hardware typically take eight to ten weeks to be delivered. A welder then fabricates the frame to hold the sections in place. Once the sections are in place the welder secures the structure making it difficult to remove a section if damage were to occur. After securing the sections in place an electrician may then provide power and data to the LED sign system. These current LED sections have external connectors for data and power. When fully assembled, there are exposed cables in the rear of the LED sign system making the cables susceptible to damage. This exposure increases the difficulty of troubleshooting failures. Additionally, many of the signs are outdoors and the power and data cables connecting the multiple section are exposed to the environment making them more susceptible to failure due to rain, ultra violet radiation, rodents such as squirrels and mice and the like. The current LED sign systems take a significant time to deploy due to the shipping schedules, and the tradesmen schedules, and are exceedingly expensive to install due to the cost of the tradesmen.

SUMMARY OF THE INVENTION

The present invention overcomes these shortcomings by providing a rapidly-deployable, configurable, modular LED sign system that can be shipped to a location in a few days, assembled on the ground and installed by non-tradesmen and technicians. Additionally, the LED sections in this preferred embodiment may be configured such that upon assembly they are aligned and locked into place using alignment pins and cooperative locks to secure the adjacent LED sections and further secured by horizontal and vertical bracing. Between the interlocking of the individual LED sections and the support structure, the completed assembly can be raised into position by a crane without fear of the assembly coming apart or the need of welder. The power and data cabling in the preferred embodiment may be equipped with waterproof quick-disconnects for the power and data thus eliminating the need for an electrician. The modular LED sign system may comprise at least one LED section but may consist multiple LED sections configured to create the desired size of display for the customer. Each LED sign section may comprise a LED panel, a power supply, a cooler, system controller, firmware, display program, power connections, data connections, cable protection, alignment mechanism, and securing mechanisms.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

The rapidly-deployable, configurable, modular LED sign system may comprise at least one LED section but may consist multiple section configured to create the desired size of display for the customer, packaged with the support mounting brackets and cabling, and support members. The LED sign system components may be stored at a central supplier facility, or at a federated set of storage facilities for quicker response, where upon request by a customer, the supplier immediately ships the desired number of packaged LED sections with the associated components to the customer for assembly. The LED sign section may comprise at least one LED panel, a power supply, a cooling system, system controller, firmware, power connections, data connections, cable protection, an alignment system, and locking mechanisms. Once the customer receives the requested number of LED sections for the desired sign size, they can rapidly assemble the LED sections with the appropriate cabling for the desired operation and affix the support members to the assemble LED sections. Upon completion of the assembly of the sign, it may be hoisted into the operating position. Assembly and installation of the LED sign system does not require skilled tradesmen such as welders and electricians. Additionally, repairing and replacement of components does not require the LED sign to be removed from the operating position but instead requires only the removal of the LED panel on the front of the LED sign section for access to the system components or the removal of the channel cover on the back for replacement of the cables. The above described rapidly-deployable, configurable, modular LED sign system is described in detail below.

Figure 1:
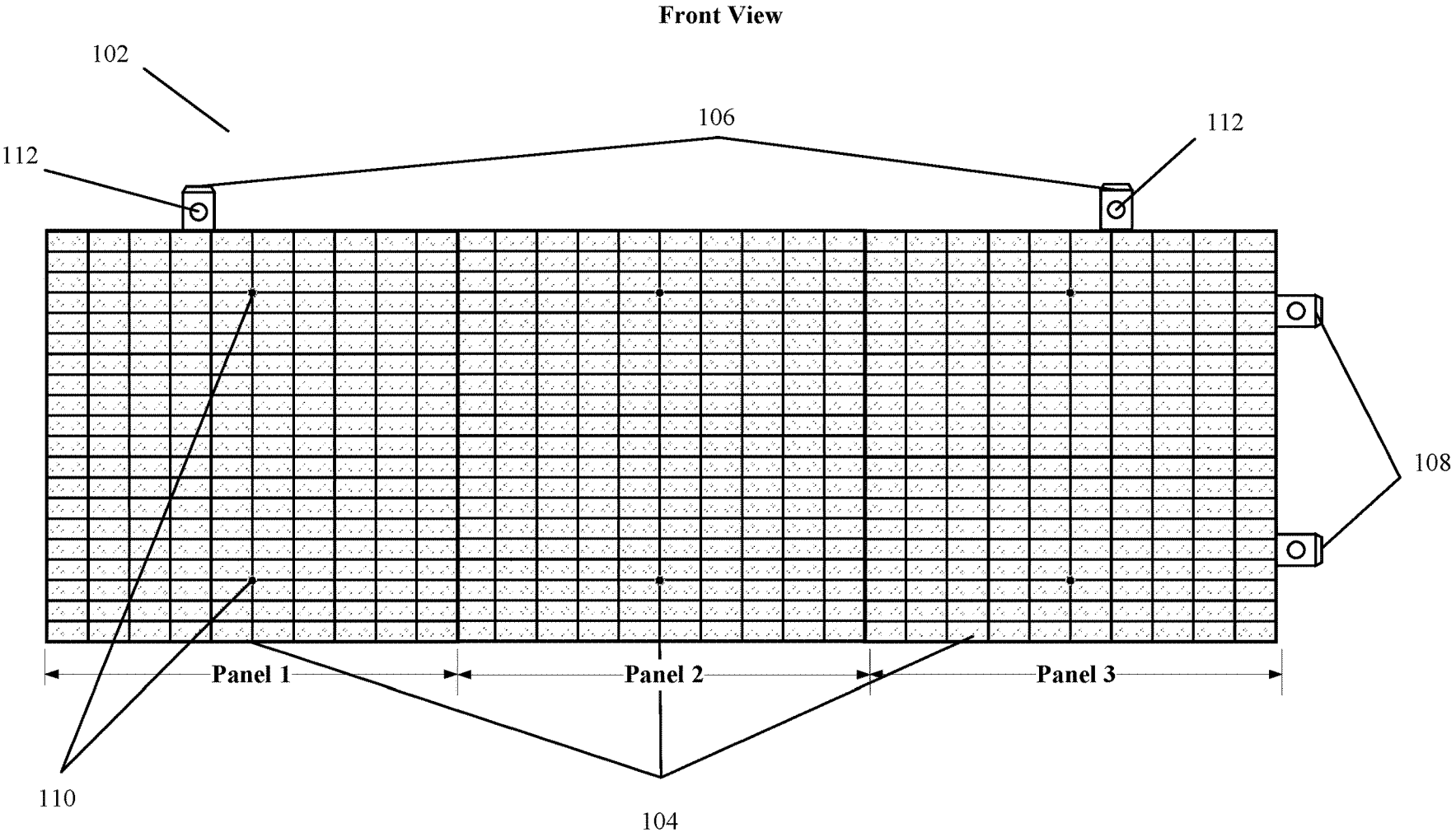
FIG. 1 is a front view of an individual LED cabinet section.

FIG. 1 is a front view of an individual LED section 102. An LED section 102 preferably comprises at least one LED panel 104, at least one upper alignment pin 106, and at least one side alignment pins 108, and LED panel lock access holes 110. Shown is an embodiment having one LED panel 104 high by three LED panels 104 wide affixed to section 102. Each LED panel 104 is one LED panel 104 high and one LED panel 104 wide thus requiring three LED panels 104 per LED section 102. One skilled in the art may use varying sizes of sections to build the desired size of display as required by the customer. These sections 102 may vary from one to four LED panels 104 wide and high, or even more for ease of assembly and installation by customer.

A customer may install and remove the LED panel 104 by inserting a LED panel tool 914 into the LED panel lock access holes 110. The LED panel tool 914 is preferably a T-handle Allen wrench. The LED panel lock access holes 110 preferably are located on the front of the LED panel 104, generally centered and located near top and bottom edges of the LED panel 104 allowing access to the LED panel locks 1008 for installation and removal of the LED panels 104. The removal and installation of the LED panels 104 is further described in detail in FIGS. 10A and B.

The upper alignment pins 106 and the side alignment pins 108 may allow the customer to build the sign on the ground by sequentially adding panels and engaging these pins 106, 108 to their corresponding alignment holes 602, 802 for alignment both vertically and horizontally. The use of the alignment pins 106, 108 and alignment holes 602, 802 is further described in detail in FIG. 19. Alignment pins 106, 108 are but one method that may be used to align the LED sections 102. Other, methods known to one skilled in the art that may be used to align the LED section 102 including, but not limited to, intercooperating pins and holes, tongue and groove, rails, retainers, and tabs and slots.

Additionally, the alignment pins 106, 108 may have attachment points 112. In the preferred embodiment, these attachment points 112 may be holes that have been machined into the pins 106, 108. These attachment points 112, allow a customer to place a tool such as a screwdriver into the attachment point 112 thus providing a handle to help maneuver and position the cabinet 202. After placement of the cabinet 202, the tool is removed for further assembly. Additionally, these attachment points 112 may be used to lift a LED section 102 into desired placement using a lift of some type.

Figure 2:
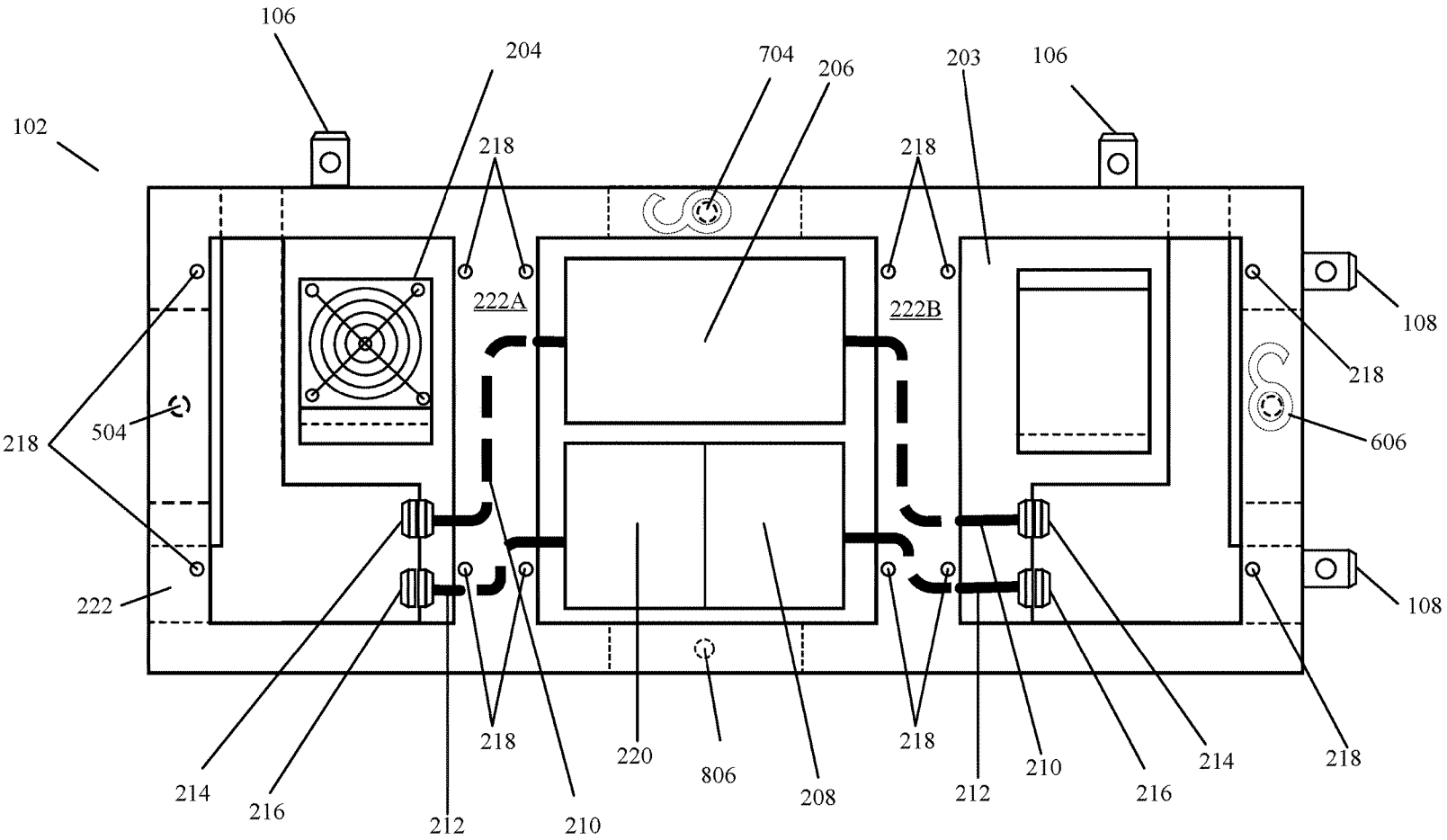
FIG. 2 is a front view of an individual LED cabinet section with the individual LED panels removed.

FIG. 2 is a front view of a cabinet 202 with the LED panels 104 removed. A cabinet 202 may comprise a cabinet 202 defines a cavity 203 therein, and may contain a plurality of LED alignment holes 218 defined in face portions 222 of the cabinet 202, and several system components including, but not limited to, a fan 204, a power supply 206 a system controller 208, internal power cables 210, internal data cable bundle 212, power bulkhead connectors 214, and data bulkhead connectors 216. In the preferred embodiment, the cabinet cavity 203 may be divided into three openings, one behind each of the LED panels 104, providing access to the system components mounted in the cabinet cavity 203. Additionally, there is space inside the cabinet cavity 203 for routing internal power cables 210 from a power supply 206 to the power bulkhead connectors 214 and LED panels 104 and internal data cable bundles 212 from the system controller 208 to the data bulkhead connectors 216 and LED panels 104.

The cabinet 202 is preferably constructed from ferrous metal but one skilled in the art may use other materials selected from non-ferrous metal, fiberglass, composite, plastic, ceramic, and polyvinyl chloride to construct the cabinet 202. Depending on the material selected by one skilled in the art, the cabinet 202 may require coatings to protect it for the sign's operating environment. Additionally, the preferred embodiment of the cabinet 202 is water resistant, and one skilled in the art may add additional sealant or use other methods to increase the cabinet's 202 water resistance. One skilled in the art may select a cabinet 202 that is waterproof for very moist environment.

In a preferred embodiment, each LED section 102 has a single power supply 206, or even common power supply but in alternate embodiments one skilled in the art may use additional power supplies 206 as required. The power supply 206 receives external A/C (in the United States, 120V A/C) power and passes the A/C power on to the adjacent power supplies 206 in the adjacent LED sections 102. This process of passing power from one power supply 206 to another continues until the last LED section 102 receives power. The power supply 206 may convert A/C power to different A/C voltages levels and D/C voltages for use by the system components and LED panels 104.

In an alternate embodiment, the power supply 206 may comprise a centralized power supply to supply power for an assembled LED sign 1902 by providing a range of A/C and D/C voltage to each LED section 102 contained within the assembled LED sign 1902. This alternate embodiment may produce less heating within each individual LED section 102 thus reducing the need for cooling in the LED sections 102.

A fan 204 is preferably used to provide cooling to the system components in the cabinet cavity 203, but one skilled in the art may select other methods of cooling including, but not limited to, a louver, an air conditioner having an evaporator and a condenser, a heat sink, and a heat exchanger, based on the operating environment. The cooling system is further shown and described in FIGS. 5 and 6.

The system controller 208 may comprise a video display section, a communication controller, and a memory section. One skilled in the art may select a system controller 208 from a system on a chip, a microprocessor, a microcontroller, and a programmable logic controller. A system on a chip is preferably used as the system controller 208 which controls the overall function of a assembled LED sign 1902 by controlling the flow of data to the other communication controllers 208 throughout the LED sign and determining the information that will be displayed on each LED section 102.

The preferred embodiment utilizes a separate system controller 208 and a communications controller 220 to display a stored video program. In an alternate embodiment, the system controller 208 and communications controller 220 may be integrated into a single controller performing both functions. The primary LED section 102 that provides the control to the assembled LED sign 1902 preferably has a system controller 208 and a communications controller 220 mounted inside the cabinet 202. Typically, the first LED section 102 in the assembled LED sign 1902 may be the primary LED section 102.

Alternate embodiments may incorporate a plurality of system controllers 208 for dynamic redundancy, meaning if the system controller 208 failed in the primary LED section 102, then a secondary LED section 102 would take control in order to keep the sign functioning and notifying the customer of a problem thus eliminating down time.

Another embodiment may have the system controller 208 mounted remotely for ease of access when used in conjunction with a large mounted sign. In this configuration, the system controller 208 may be mounted below the sign 1902 support structure in a lockable weather-proof cabinet for easy access by the customer. Additionally, the customer may store a system interface device such as computer, tablet, or the like within the weather-proof cabinet for service and programming of the sign 1902.

The system controller 208 may be programmed onsite after the LED sign is completely assembled. The system controller 208 may also be programmed remotely after the LED sign is assembled and functionally checked. This allows a customer with multiple LED signs in multiple locations to be programmed from a single location.

The system controller 208 may be programmed to display basic dynamic video information including, but not limited to, photos, videos, analog and digital clocks. Additionally, the system controller 208 may display stored video and may accept video input from including, but not limited to, HDMI, VGA, DVI, Display Port, and other video adapter sources. Typically, the external video may be from live advanced dynamic events including, but not limited to, camera feeds, video games, scoreboards, and live television displaying sporting events like football or horse racing. The system controller 208 receives the live video feeds then processes the video data and transmits the video message to the communication controller 220 located in the primary LED section 102 in the chain of LED sections 102 and continues the process until all the LED sections 102 have received video data. Further, the system controller 208 may display a combination thereof in a picture-in-picture fashion, displaying both basic and advanced dynamic content simultaneously on the assembled LED sign 1902.

In addition to these types of programming methods for the LED sign described above, the LED sign may be assembled at the supplier's location, programmed with the customer's information, then repackaged and sent to the customer for immediate assembly and installation without the need to program the LED sign on site. The system controller 208 takes the video program which may be stored or from live video and create a video message to send the different LED sections 102. The video message may contain header type information and video data. This information is sent to receive section of the communication controller 220.

The communication section of the system controller 208 transmits and receives data through a wired connection that may allow a customer to upload a desired video program into the memory residing on the system controller 208 and perform other programming and maintenance functions. Additionally, the communication section of the system controller 208 may control the data and control information being sent between the communication controllers 220 within the LED sections 102. The system controller 208 may be directly wired to the local network. The communications section of the system controller 208 may also communicate with the LED sign 1902 through a wireless connection to provide data and control information. One skilled in the art may also connect the system controller 208 to a wireless network including, but not limited to, a local area network, a wide-area network, wireless hotspots, internet, and broadband cellular network. This enables the customer to connect to the system controller 208 using an interface device including, but not limited to, desktop, laptop, tablet, and a smartphone. Additionally, the system controller 208 may create its own access point wireless allowing the customer to connect when in range to send programs and control information by smartphone, tablet, or laptop.

The video display section receives data and control information and then determines which LED section 102 will display which portion of the video program within the LED sign. The video display section then provides the data to the individual LED panels 104 within the LED section 102. The memory section may store firmware or and operating system and at least one video program. The memory may be of sufficient size to store multiple video programs. Additionally, the memory may be expandable to host a greater number of video programs or more high definition video programs.

Depending on the size of the LED section 102, one skilled in the art may determine additional system components may be required to operate the LED section 102 including, but not limited to, additional power supplies 206, fans 204, and system controllers 208. Also displayed in this view is the right-side hook lock 606 and left-side lock pin 504 that will be described in greater detail in FIGS. 5 and 6. Similarly, a top hook to engage cooperatively bottom lock pin 806 as shown and further described in FIGS. 7 and 8.

The communication controller 220 may comprise a receiving section, a display section and a transmit section. Each LED section 102 preferably has least one communications controller 220 where the communication controller 220 receives a video message from the system controller 208. The communication controller 220 analyzes the message to determine which portion of the message is destined for the specific LED section 102 and then retrieves and display the pertinent video information. Additionally, the communication controller 220 transmits the remaining portion of the video message to the subsequent LED section 102 until the last section is reached. These video display messages are continually sent while the specified program is running. In the preferred embodiment, the messages are sent serially through the data connections. However, in an alternate embodiment, the video messages may be sent in parallel to reduce lag time.

In the LED section 102 described above, the communications controller 220 may send data to each LED panel 104, individually in a parallel fashion. Additionally, the LED panels 104 may be configured in a serial fashion where the communications controller 220 may send data to the first LED panel 104 through the data connection 1016. Similar to the process above, the LED panel's circuit board 1012 analyzes the video message to determine which portion of the message is destined for the specific LED panel 104 and then retrieves and displays the pertinent video information for that specific LED panel 104. Additionally, the LED panel 104 then re-transmits the message out of the remaining data connection 1016 on the LED panel 104, which is connected to the adjacent LED panel's 104 data connection 1016 via a data cable similar to internal data cable bundle 212. Each LED panel 104 re-transmits the remaining portion of the video message to the subsequent LED panels 104 until the last LED panel 104 within a LED section 102 is reached.

Figure 3:
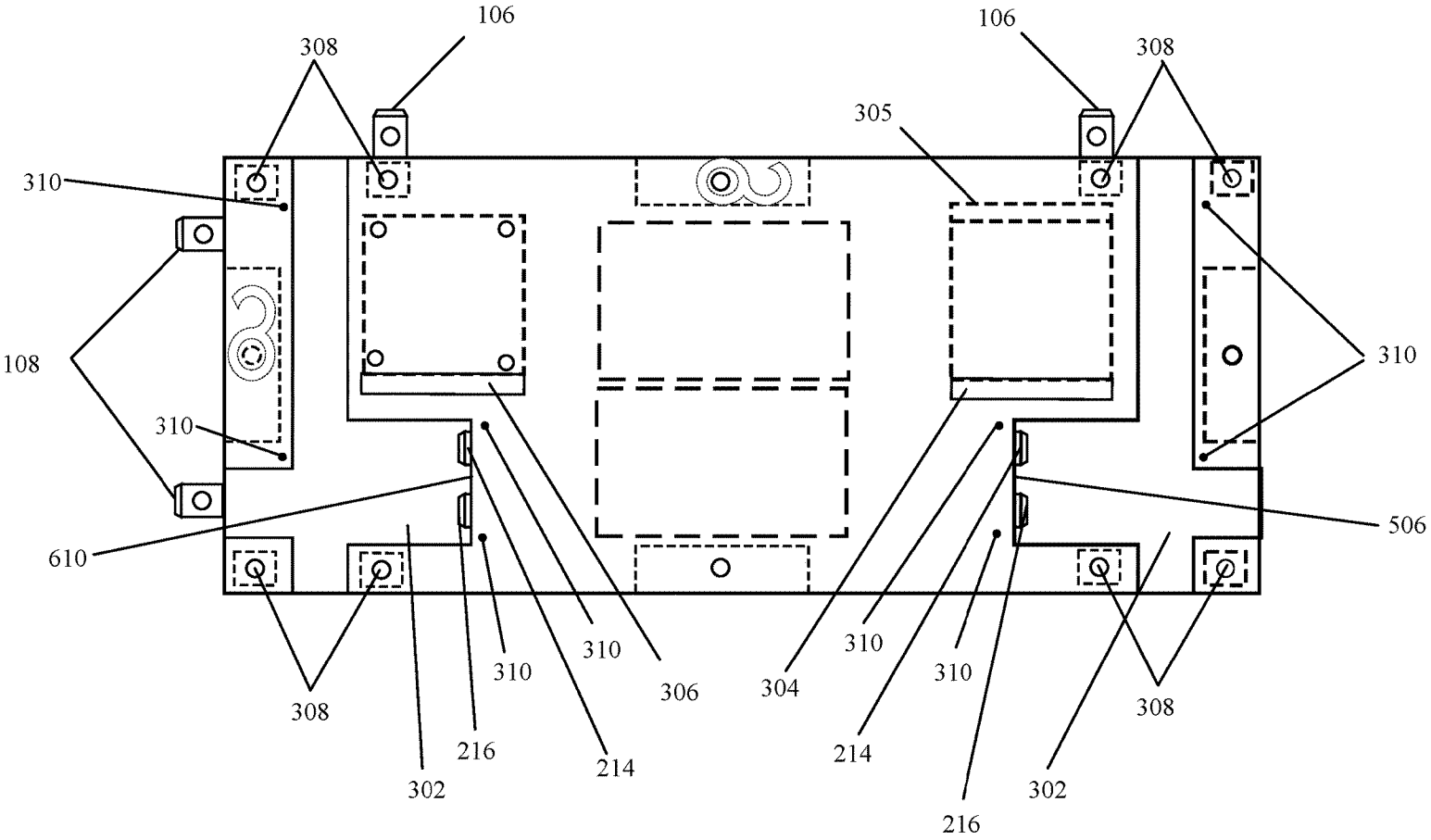
FIG. 3 is a rear view of the individual LED cabinet.

FIG. 3 is a rear view of the individual LED cabinet 202. The cabinet 202 defines therein a cable channel 302, an external air intake 304, an internal air intake 305, an external air exhaust 306, a plurality of bracket mount retainers 308 and cover plate mounting holes 310. The cable channel 302 extends vertically to the top and bottom of the cabinet 202. This portion of the cable channel 302 allows power cables 2402 and data cables 2404 to connect to adjacent LED sections 102 both above or below. Additionally, the cable channel 302 extends horizontally to the proximal edge of the cabinet 202 on both ends. The horizontal portion of the cable channel 302 is not continuous across the width of the cabinet 202. The other end of the horizontal portion cable channel 302 end at the right-side bulkhead 506 and the left-side bulkhead 610. Affixed to these bulkheads 506, 610 are the power bulkhead connectors 214 and the data bulkhead connectors 216.

The cable channel 302 may be covered with cover plate 402 to protect the power cables 2402 and data cables 2404 from the environment. The cover plate 402 may be affixed using standard fasteners that pass through the cover plate attachment points 404 and engage the cover plate mounting holes 310, thus removably retaining the cover plate 402.

In the preferred embodiment, there are at least two bracket mount retainers 308 positioned at corners of the cabinet 202 allowing for the support brackets 1102, 1502 to be affixed to the cabinet 202. Preferably there are four bracket mount retainers 308 positioned at the four corners of the cabinet 202, allowing for multiple mounting configurations based on the customer requirements. The support brackets 1102, 1502 are further described in detail in FIG. 11 and FIG. 15. Additionally, the bracket mount retainers 308 allow for two sections be connected and attached to a vertical support member 1702. The bracket mount retainers 308 may accept fasteners known to one skilled in the art including, but not limited to, screws, bolts, nuts, keys, pins, clips. and cam connectors, and cam lock.

Figure 4:
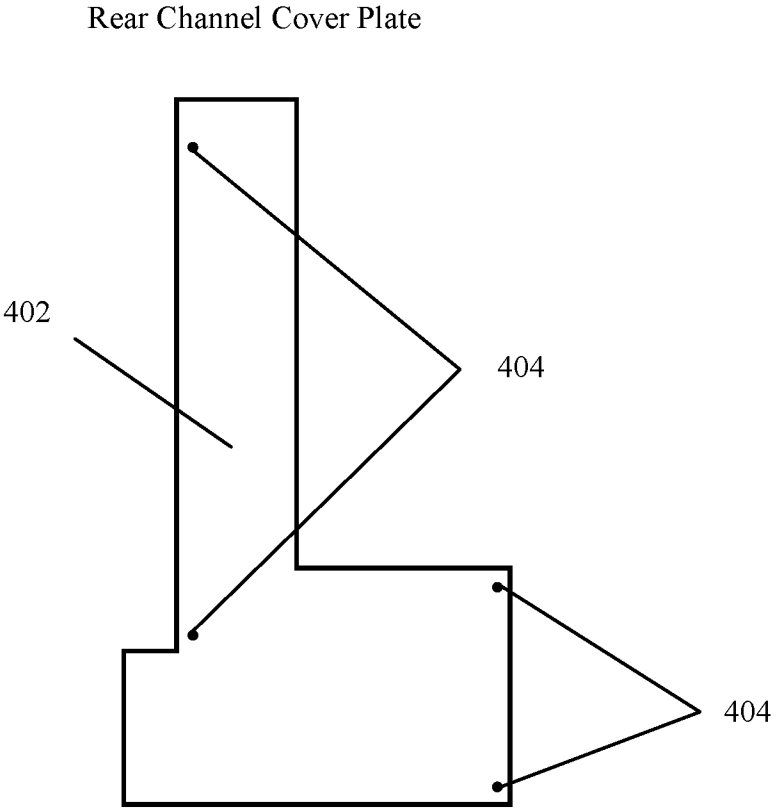
FIG. 4 is a top view of the LED cabinet rear channel cover plate.

FIG. 4 is a top view of the LED cabinet rear channel cover plate 402. This rear channel cover plate 402 covers substantially all the cable channel 302. In the preferred embodiment a portion of the rear channel cover plate 402 extends vertically to cover the vertical portion of the cable channel 302. Additionally, the rear channel cover plate 402 extends horizontally to cover the horizontal portion of the cable channel 302. One skilled in the art may chose other cover plate 402 configurations that are more suitable to their operating environment. A gasket or other seal mechanism may be provided to minimize water intrusion A plurality of cover plate attachment points 404 may be defined within the rear channel cover plate 402 for affixing the cover plate 402 to the cabinet 202. In the preferred embodiment, the attachment points 404 are holes that allow fasteners such as screws to penetrate the cover plate 402 to engage the cover plate mounting holes 310 that are defined in the face portions 222. Other type fasteners known to one skilled in the art may be used to secure the cover plate 402 to the cabinet 202.

The cover plate 402 may be installed after the cabinets 202 have been assembled and the associated power cables 2402 and data cable 2404 have been installed on the bulkhead connectors 214, 216. The rear channel cover plate 402 protects the power cables 2402 and the data cable 2404 that run between each of the LED sections 102. This cover plate 402 prevents exposure to ultraviolet rays and also prevents exposure to various animals to include rodents that may damage the cables, specifically squirrels. The cover plate 402 is preferably constructed from metal but other materials suitable for the operating environment may be used. Additionally, if the cover plate 402 is made from a ferrous material, the cover plate 402 may be treated with rust resistant coatings to prevent degradation.

Figure 5:
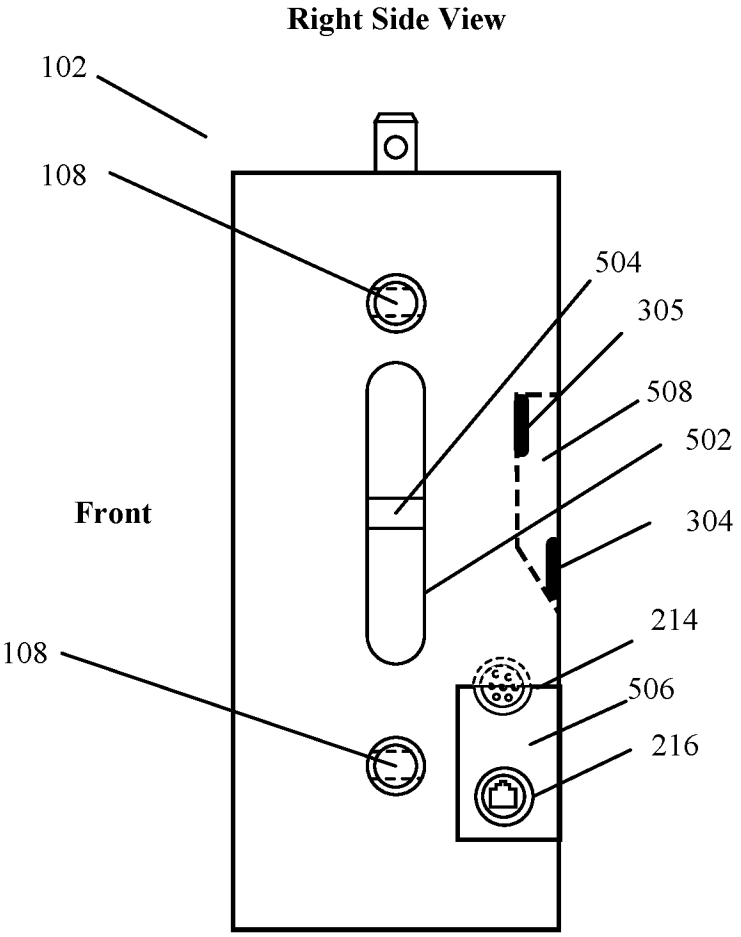
FIG. 5 is a right-side view of an individual LED cabinet section.

FIG. 5 is a right-side view of an individual three LED panel cabinet 202. A right side of the cabinet 202 may comprise a right-side lock pin housing 502 for a right-side lock pin 504, a right-side bulkhead 506 housing a power bulkhead connector 214 and data bulkhead connector 216, side alignment pins 108, and the air intake plenum 508 with an external air intake 304 and an internal air intake 305. The right-side lock pin housing 502 may be rigidly affixed flush to the cabinet's 202 right side 500. In the preferred embodiment, the right-side lock pin housing 502 is hollow to accept the corresponding left-side hook lock 606 as it captures the right-side lock pin 504. The interaction between the left-side hook lock 606 and the right-side lock pin 504 will described in more detail in connection with FIG. 6. Additionally, the side alignment pins 108 may centered longitudinally to align with the right-side lock pin 504. The side alignment pins 108 in this preferred embodiment may be aligned along the longitudinal axis and in-line with the right-side lock pin housing 502.

The right-side bulkhead 506 may be part of the horizontal portion of the cable channel 302 where the power bulkhead connector 214 and data bulkhead connector 216 reside. The preferred embodiment incorporates a quick-disconnect type connector for both the power bulkhead connector 214 and data bulkhead connector 216, however, one skilled in the art may use different types of connectors based on the LED signs operating environment. These bulkhead connectors 214, 216 may preferably be positioned on the vertical bulkhead to prevent damage but one skilled in the art may select other suitable positions for the bulkhead connectors 214, 216 are as long as the positions do not degrade the power or data signal entering into the cabinet 202. Further, these quick-disconnect bulkhead connectors 214, 216 may be watertight to provide protection from the environment including moisture and dust. By using quick-disconnect connectors, the power cables 2402 and the data cables 2404 may be removed without tools thereby making the removal and replacement simpler and quicker. An air intake plenum 508 allows air to enter the cabinet 202 through external air intake 304 travel through the air intake plenum 508 and exit into the cabinet 202 through the internal air intake 305. The outside air may be allowed to intermix with the heated air inside the cabinet 202, then exhausted to the outside, thus cooling the system components in the cabinet 202. In the preferred embodiment, the air intake plenum 508 has an opening for external air intake 304 at the bottom of the air intake plenum 508. This opening receives the outside air into the air intake plenum 508 and the internal air intake 305, an opening at the top of the air intake plenum 508 on the opposing side, allows the air to be pulled into the cabinet 202 for cooling. Additionally, the side of the air intake plenum 508 opposite the internal air intake 305 is slanted such that it prevents water from entering the cabinet 202.

In an alternate embodiment, the cooling may be centralized into a single location and then distributed to each of the LED sections 102. A customer may use a medium such as a liquid and a gas to distribute the cooling to each of the LED sections 102. This medium may also be used to remove the heat from individual LED sections 102.

Figure 6:
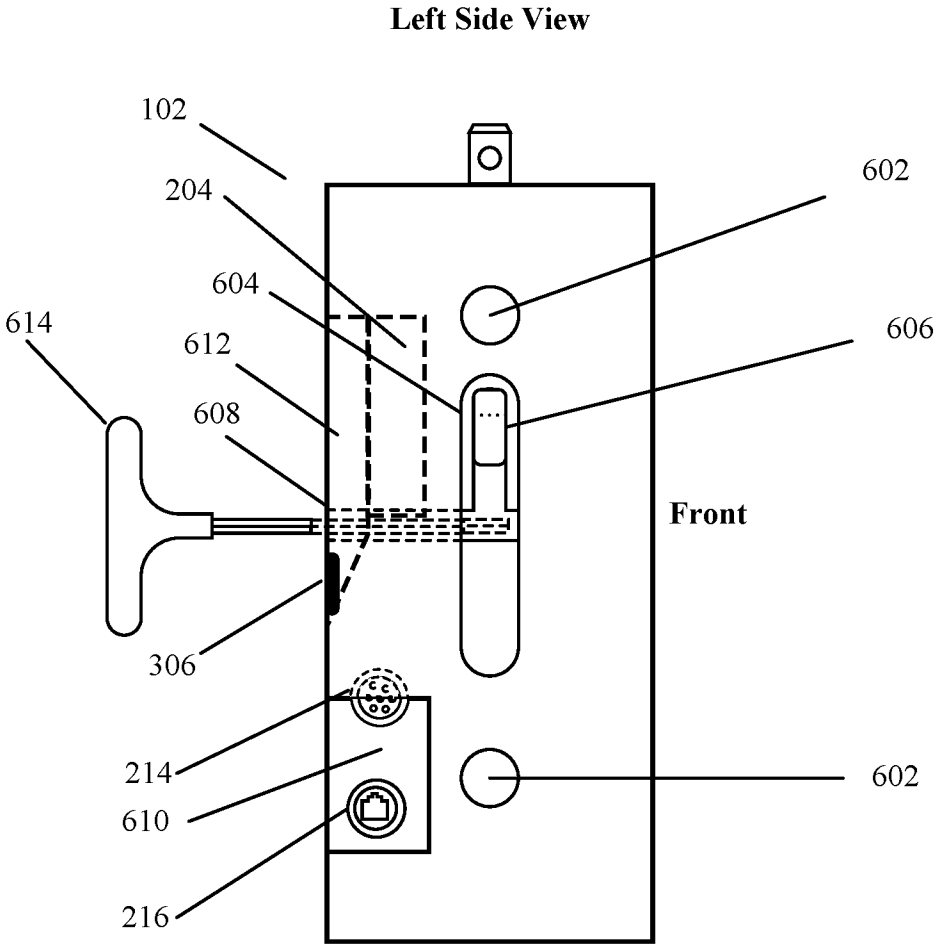
FIG. 6 is a left-side view of an individual LED cabinet section.

FIG. 6 is a left-side view of an individual three LED panel cabinet 202. A left-side of the cabinet 202 may comprise alignment holes 602, left-side hook lock housing 604 for a left-side hook lock 606, lock key access 608, a left-side bulkhead 610, housing a power bulkhead connector 214 and data bulkhead connector 216, and the air exhaust plenum 612 with a fan 204 and an external air exhaust 306. The left-side hook lock housing 604 may be rigidly affixed flush to the cabinet's 202 left side. In the preferred embodiment, a single left-side hook lock 606 is centered both laterally and longitudinally on the side of the cabinet 202. In alternate embodiments, one skilled in the art may chose more than one left-side hook lock 606 along the side of the cabinet 202. Additionally, one skilled in the art may not center the top hook lock 704 but may place the top hook lock 704 in an offset position to better accommodate the internal components. The left-side hook lock housing 604 may allow the left-side hook lock 606 to be rotated into the locked and unlocked position. In the preferred embodiment, the left-side hook lock housing 604 holds the left-side hook lock 606 in the unlocked position where the left-side hook lock 606 is below the edge of the cabinet 202 and contained within the left-side hook lock housing 604. This positioning prevents the left-side hook lock 606 from being damaged when not in use. Additionally, this is the preferable position of the left-side hook lock 606 during packaging and shipping. Additionally, the alignment holes 602 may be centered longitudinally to align with the left-side hook lock 606. The alignment holes 602 in this preferred embodiment may be aligned along the longitudinal axis and in-line with the left-side hook lock 606.

Also, pictured in left-side view is a locking tool 614 that is used to actuate the left-side hook lock 606. The locking tool 614 may comprise a handle and elongated hexagonal shaft at a size that would be apparent to one skilled in the art where the shaft is inserted into the left-side hook lock 606 to actuate the lock. The locking tool 614, may be an Allen wrench, which is a common tool used by one skilled in the art and is not supplied with the LED sections 102. Other types of tools, and locks known to one skilled in the art made be used to secure cabinets 202 together. During LED sign assembly, the customer may place two LED sections 102 side-by-side and align the two side alignment pins 108 on the right side of one LED section 102 with the corresponding alignment holes 602 on the left side of the adjacent LED section 102 then actuate the left-side hook lock 606 to bring the LED section 102 together in the locked position. In doing so, the two side alignment pins 108 engage the corresponding alignment holes 602 of the adjacent LED section 102. As the left-side hook lock 606 is rotated, it captures the corresponding right-side lock pin 504 on the adjacent LED section 102. Additionally, as the customer continues to rotate the locking tool 614 in the locking direction, a cam in the left-side hook lock 606 draws the left-side hook lock 606 tightly into the left-side hook lock housing 604 thereby pulling the LED section 102 together creating a seamless LED panel 104. This process is continued until the desired width of an assembled LED sign 1902 is obtained.

The left-side bulkhead 610 may be part of the horizontal portion of the cable channel 302 where the power bulkhead connector 214 and data bulkhead connector 216 reside. As described above, the power bulkhead connector 214 and data bulkhead connector 216 are preferably positioned on the vertical bulkhead to prevent damage and are waterproof quick-disconnect type bulkhead connectors 214, 216.

An air exhaust plenum 612 allows heated air inside the cabinet 202 to be pulled through the fan 204 which then pushes the heated air into the air exhaust plenum 612 where the heated air travels down and out through the external air exhaust 306. Preferably, the air intake plenum 508 and the air exhaust plenum 612 are spaced such that the heat generating system components reside between the plenums 508, 612 to allow air flow across the components and pull the heat away thereby providing maximum cooling and increased longevity of the system components. However, one skilled in the art may consider other cooling configurations based on different operating environments that may be desirable. As described previously for the air intake plenum 508, the side of the air exhaust plenum 612 opposite the external air exhaust 306 is slanted to prevent water from entering the cabinet 202.

Figure 7:
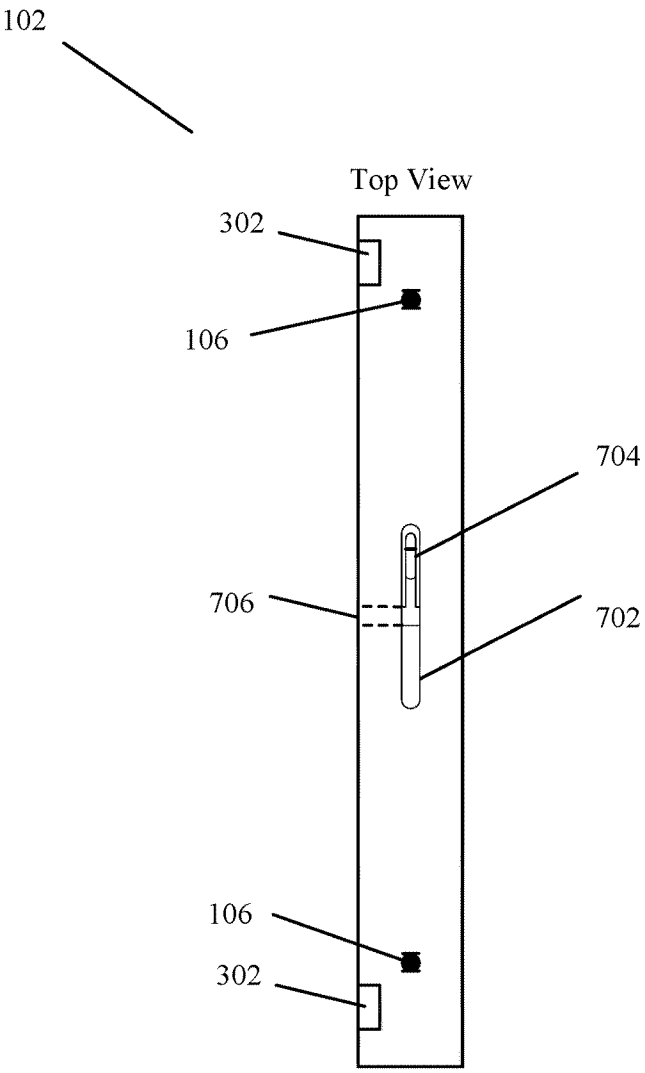
FIG. 7 is a top view of an individual LED cabinet section.

FIG. 7 is a top view of an individual LED cabinet 202. The top view illustrates the placement of the upper alignment pins 106, the top of the cable channels 302 and a top hook lock housing 702 retaining a top hook lock 704. In the preferred embodiment, a single top hook lock housing 702 is centered both laterally and longitudinally on the top of the cabinet 202. The top hook lock 704 may be actuated by inserting a hex key into the hook lock key access 706 to engage the top hook lock 704 allowing the top hook lock 704 to be rotated to the lock and unlock positions. The operation of the hook lock was described in detail FIG. 6. In alternate embodiments, one skilled in the art may chose more than one top hook lock 704 along the top of the cabinet 202. Additionally, one skilled in the art may not center the top hook lock 704 but may place the top hook lock 704 in an offset position to better accommodate the internal components. Preferably, two upper alignment pins 106 may be used to align the LED section 102 both longitudinally and laterally. However, one skilled in the art may add additional upper alignment pins 106 to assist with aligning the LED section 102.

Figure 8:
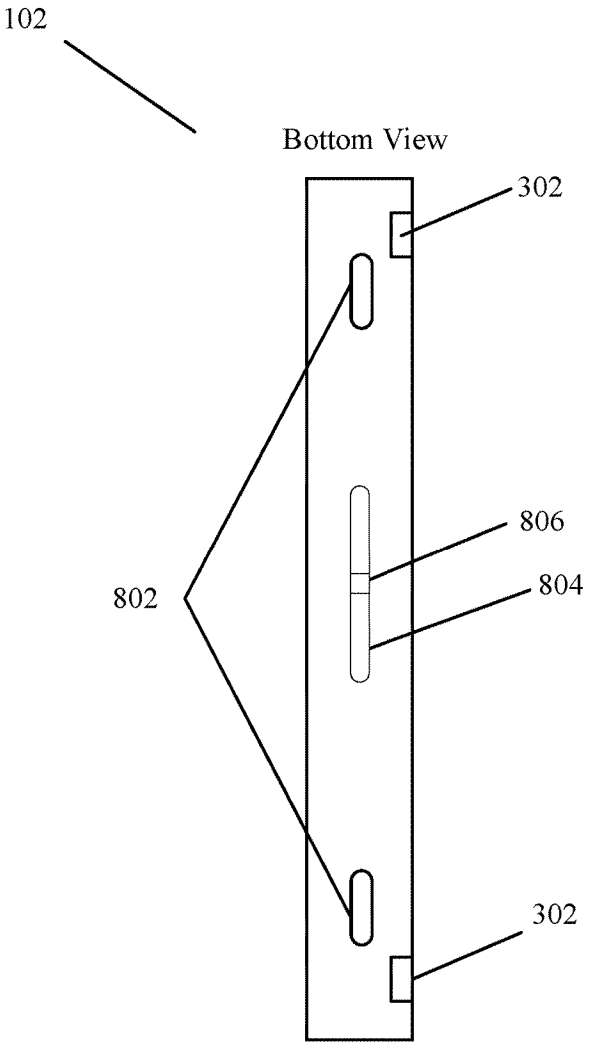
FIG. 8 is a bottom side view of an individual LED cabinet section.

FIG. 8 is a top view of an individual LED cabinet 202. The top view illustrates the placement of the elongated alignment holes 802, the bottom of the cable channels 302 and a bottom lock pin housing 804 retaining a bottom lock pin 806. In the preferred embodiment, a single bottom lock pin 806 is centered both laterally and longitudinally on the bottom of the cabinet 202. In alternate embodiments, one skilled in the art may chose more than one bottom lock pin 806 along the bottom of the cabinet 202 to mate with a corresponding top hook lock 704. Additionally, one skilled in the art may not center the bottom lock pin 806 but may place the bottom lock pin 806 in an offset position that mates with a corresponding top hook lock 704.

Preferably, two elongated alignment holes 802 may be used to align the LED section 102 both longitudinally and laterally. The elongated alignment holes 802 in this particular embodiment are elongated along the longitudinal axis and in-line with the bottom lock pin housing 804. The elongated alignment holes 802 allow for easier assembly as described hereinafter. Once a bottom row of LED sections 102 have been assembled, the customer places the next LED section 102 on top of this completed LED section 102 row. The customer will typically start at one end and place LED sections 102 on the previously assembled row. Once the LED section 102 is secured in position, the next LED section 102 may be placed adjacent to the previously installed LED section 102. Preferably, the elongated alignment holes 802 are elongated such that a customer may place the LED section 102 on top of the top upper alignment pins 106 without interfering with the side alignment pins 108 of the adjacent LED section 102. After placement, the customer may slide the LED section 102 toward the adjacent installed LED section 102 to engage the alignment holes 602 with side alignment pins 108. Once the side alignment pins 108 have sufficiently engaged the elongated alignment holes 802, the left-side hook lock 606 may be actuated to engage the corresponding right-side lock pin 504 securing the LED section 102 in place. Additionally, the top hook lock 704 on the LED section 102 below may be actuated to affix the current LED section 102 being installed to the completed LED sections 102 below. However, one skilled in the art may add additional elongated alignment holes 802 to assist with aligning the LED section 102.

Figure 9:
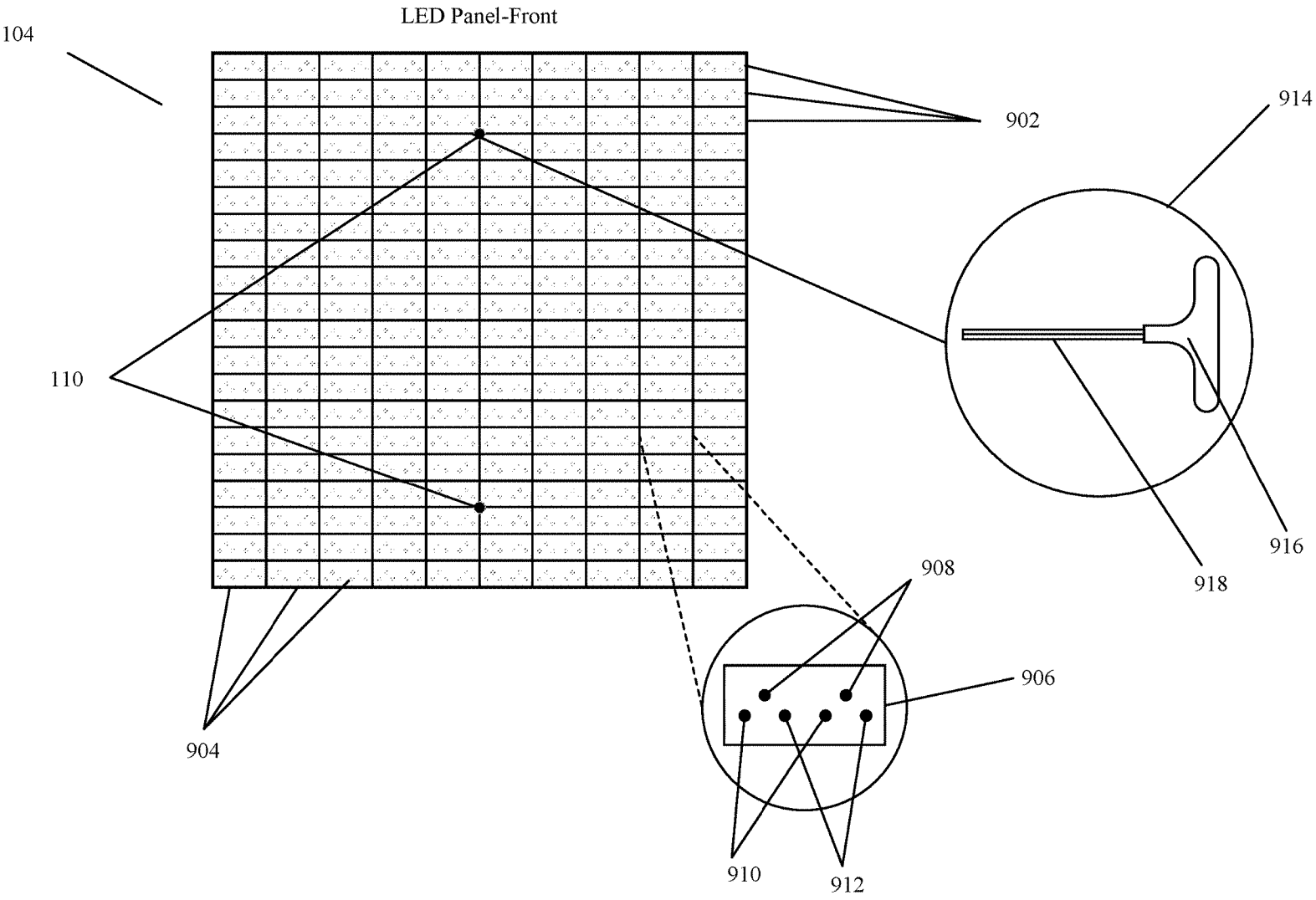
FIG. 9 is a front view of an individual LED panel.

FIG. 9 is a front-view of an individual LED panel 104. The LED panel 104 may comprise a series of LED rows 902 and a series of LED columns 904 with the intersection of the rows 902 and columns 904 creating a LED segment 906 and LED panel access holes 110. In the preferred embodiment there are 10 columns 904 and 20 rows 902 leading to 200 segments per LED panel 104.

Each LED segment 906 has a series of blue LEDs 908, green LEDs 910 and red LEDs 912. In FIG. 9 there is an exploded view of an LED segment 906 that illustrates the position and placement of the different colored LEDs 908, 910, 912. As can be seen in the LED segment 906, the LEDs 908, 910, and 912 are arranged in a triangle and there are two of these LED 908, 910, 912 triangles per segment. Other size panels may be constructed based on the requirements of one skilled in the art. In the current embodiment, the cabinet 202 is a one by three LED cabinet 202 that will accept three LED panels 104 to be releasably attached to the front of the cabinet 202 by the LED panel lock 1008.

To releaseably affix the LED panel 104 to the cabinet 202, the user inserts a specialized LED panel tool 914 into the LED panel lock access holes 110 located on a face of the LED panel 104 and rotates the LED panel lock 1008 to secure the LED panel 104 in place. This same process may be used to remove the LED panel 104 by rotating in the opposite direction. The specialized LED panel tool 914 may comprise of a T-handle 916 and a long hexagonal shaft 918 sized to engage the LED panel lock 1008. Additionally, in the preferred embodiment, the specialized LED panel tool 914 may shipped with the LED sections 102.

Figure 10A:
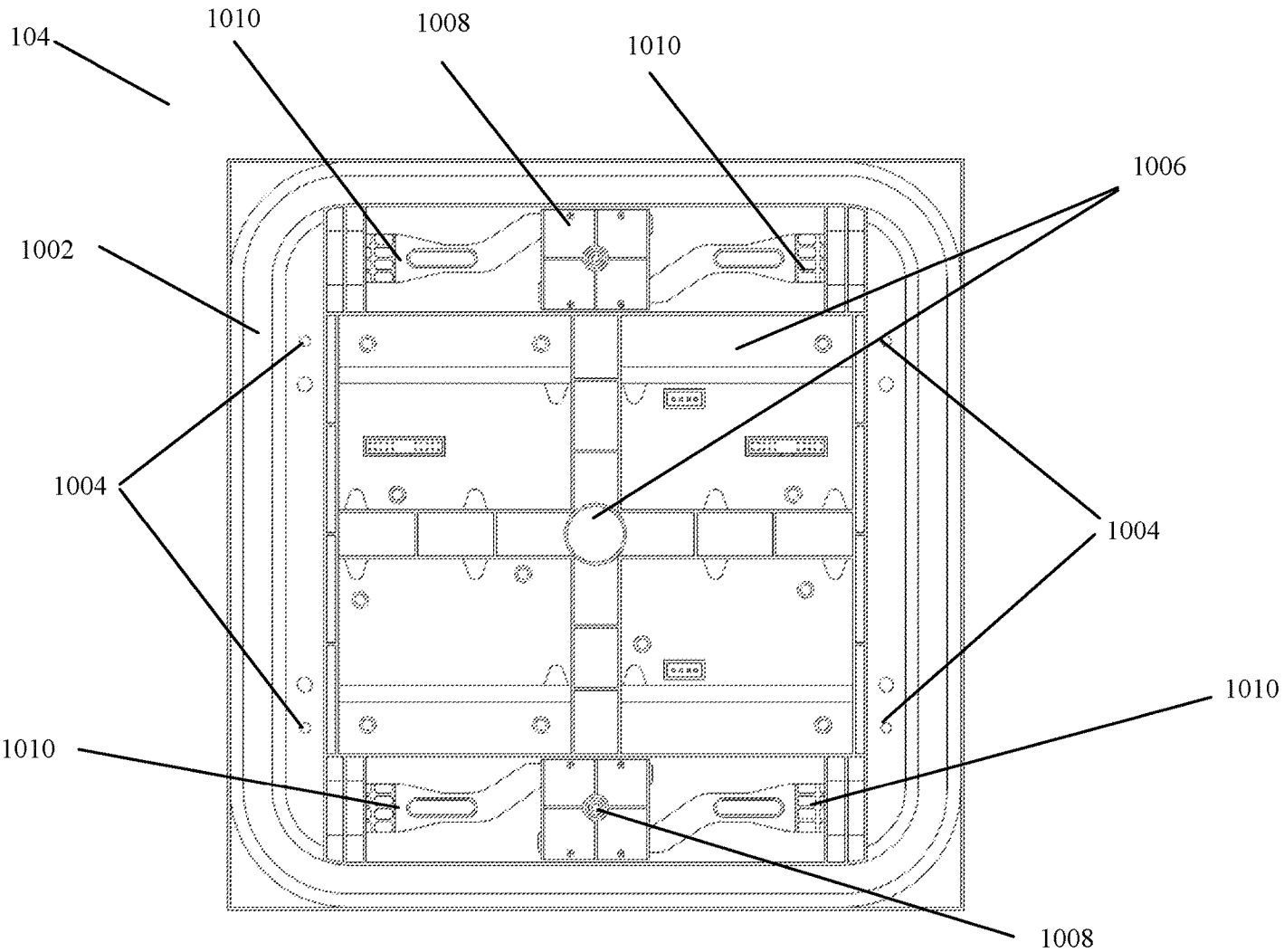
FIG. 10A is a rear view of an individual LED panel with the panel lock arm retracted.
Figure 10B:
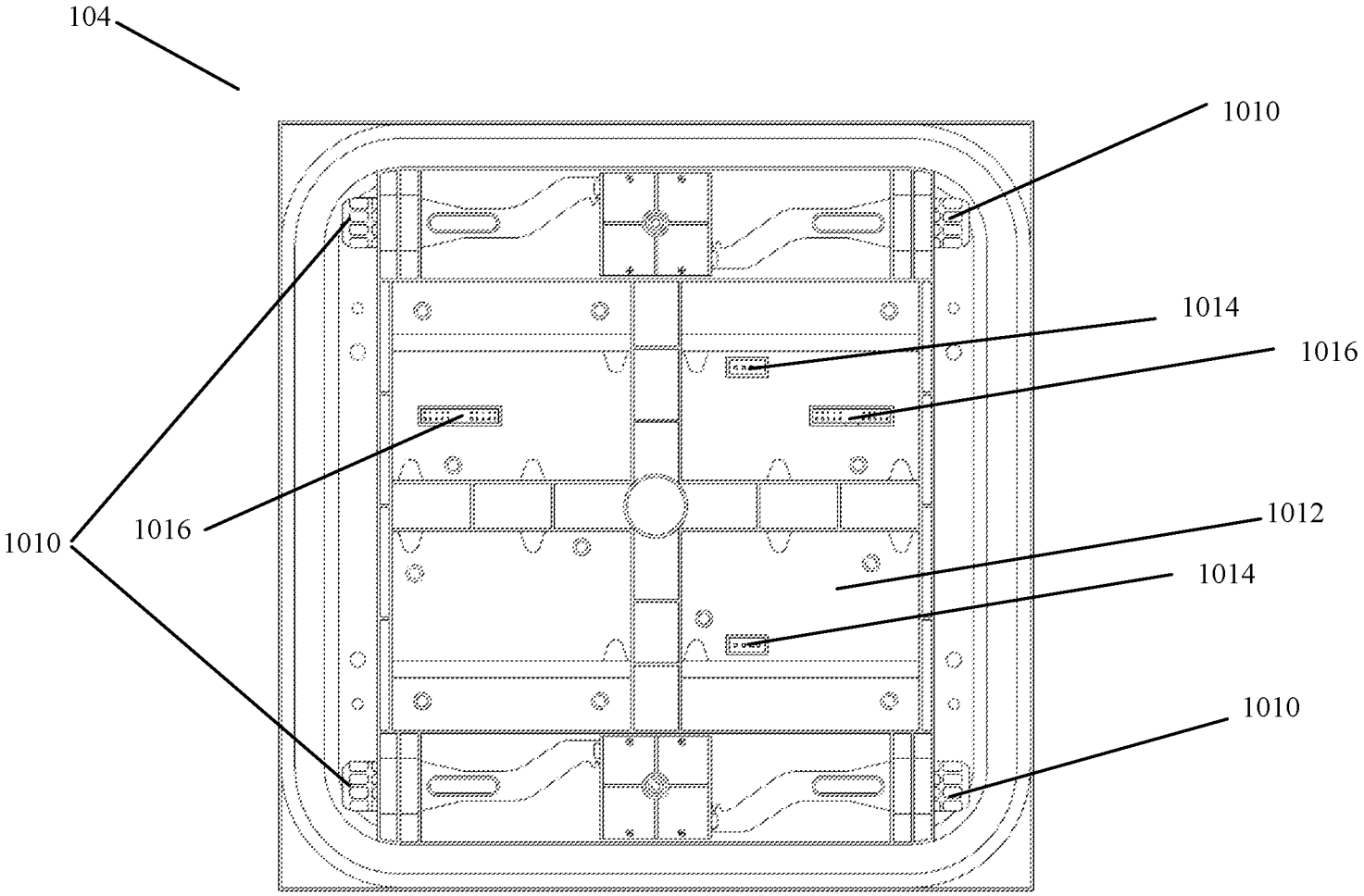
FIG. 10B is a rear view of an individual LED panel with the panel lock arm extended.

FIGS. 10A and 10B are rear views of an individual LED panel 104 with FIG. 10A showing the panel in the unlocked position and FIG. 10B showing the panel in the locked position. The LED panel 104 may comprise a seal 1002, LED alignment pins 1004, an internal rigid structure 1006, LED panel lock 1008, and locking arms 1010. In the preferred embodiment the LED alignment pins 1004 are mated with the corresponding LED alignment holes 218. These LED alignment holes 218 and the corresponding LED alignment pins 1004 help align the LED panels 104 horizontally and vertically on the cabinet 202 to ensure a monolithic view for each LED section 102 and to also create a monolithic view, well-aligned for a series of LED sections 102 that are stacked one on top of the other. Once the LED panel 104 is positioned so as that the LED alignment pins 1004 are positioned above the corresponding LED alignment holes 218 then the customer presses the LED panel 104 is pressed into place compressing the seal 1002 and engaging the LED panel locks 1008 to secure the LED panel 104 in place. The LED panel locks 1008 are activated by a LED panel tool 914 passed through the LED panel lock access holes 110 on the opposite side of the LED panel 104. Upon engaging the LED panel locks 1008, the seal 1002 is compressed such that it prevents water from entering into the cabinet cavity 203.

In the preferred embodiment there is an internal rigid structure 1006 that prevents the LED panel 104 from flexing, thus preventing the circuitry inside from being damaged. The internal rigid structure 1006 preferably consists of a series of horizontal legs, with a center leg going from the top to the bottom of the internal rigid structure 1006. In the preferred embodiment, the rigid structure is made from plastic, however this structure could also be made from other materials including ferrous and nonferrous metals.

FIG. 10A illustrates the locking arms 1010 of the LED panel lock 1008 in the retracted position in preparation for LED panel's 104 removal or installation. In the preferred embodiment, there are four of these locking arms 1010. A customer may insert a tool into the LED panel lock 1008 and rotate to extend or retract these arms through a gearing system. In the preferred embodiment, the customer inserts a LED panel tool 914 which, may be a T-handled elongated hex key, into the LED panel lock access holes 110 to engage the LED panel lock 1008 and rotate the lock to the unlock position disengaging the locking arms 1010 from the cabinet 202 allowing the LED panel 104 to be removed. In this view, the upper and lower LED panel locks 1008 have both locking arms 1010 retracted.

FIG. 10B illustrates the LED panel locks 1008 in the locked position where the LED panel locks 1008 have been rotated such that the locking arms 1010 are extended to engage the cabinet 202 and capture and retain the LED panel 104 in the desired operating position. FIG. 10B also illustrates the power connections 1014 and data connections 1016 affixed to the LED Circuit Board 1012. In the preferred embodiment there are two power connections 1014 and two data connections 1016, but only a single power connection 1014 and single data connection 1016 are utilized. The power connection 1014 provides power from the power supply 206 that is housed inside the cabinet 202 to the LED panel 104. Additionally, the system controller 208 housed in the cabinet 202 provides data to the LED panel 104 through the data connection 1016.

Figure 12:
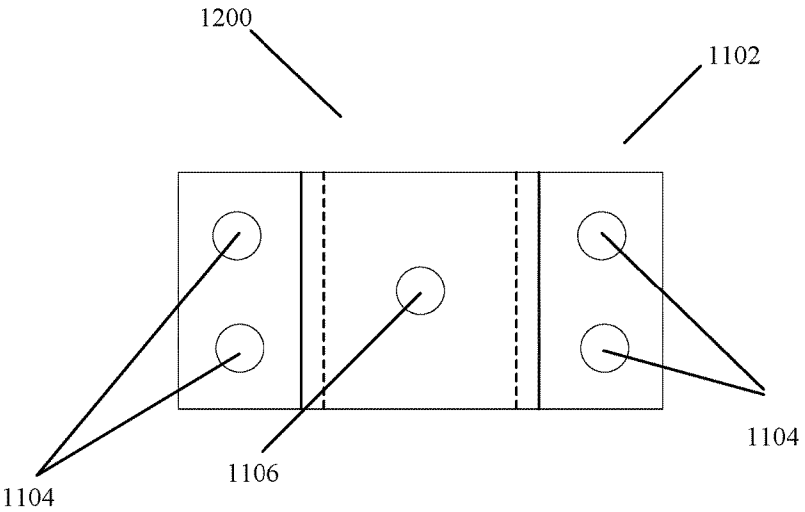
FIG. 12 is a top view of a U-support mounting bracket.
Figure 11:
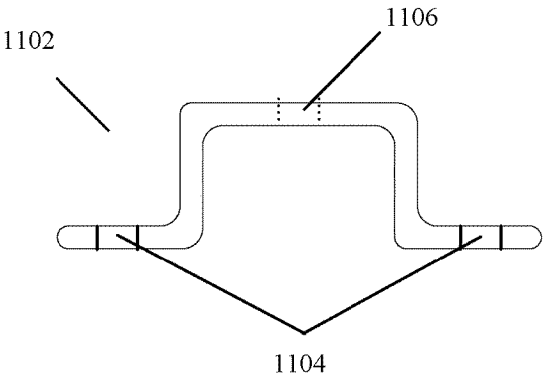
FIG. 11 is an end view of a U-support mounting bracket.

FIG. 11 and FIG. 12 are an end view and a top view of a U-bracket 1102, respectively. In the preferred embodiment, the U-Bracket 1102 may have integral flanges extending on either side of the U-shape and contain two cabinet mounting holes 1104 in each flange. In addition, the U-bracket may be sized to straddle the intersection of four LED sections 102 both horizontally and vertically such that the cabinet mounting holes 1104 align with the bracket mount retainers 308 located in each of the corner of the LED section 102. The U-bracket 1102 preferably surrounds a vertical support member 1702 on three sides. The U-bracket 1102 may be used in cooperation with a mounting plate 1302 to rigidly affix the vertical member 1702 to the assembled sign 1902 once the vertical bracket mounting fasteners 2006 are installed. Additionally, the U-bracket 1102 may also be secured directly to the to the vertical member 1702 by installing a fastener through a support member mounting hole 1106. One skilled in the art may select materials including, but not limited to, ferrous and non-ferrous metal, carbon fiber, fiberglass, and plastic to construct the U-bracket 1102. The U-bracket 1102 is preferably coated with rust resistant materials to protect and prevent corrosion.

Figure 13:
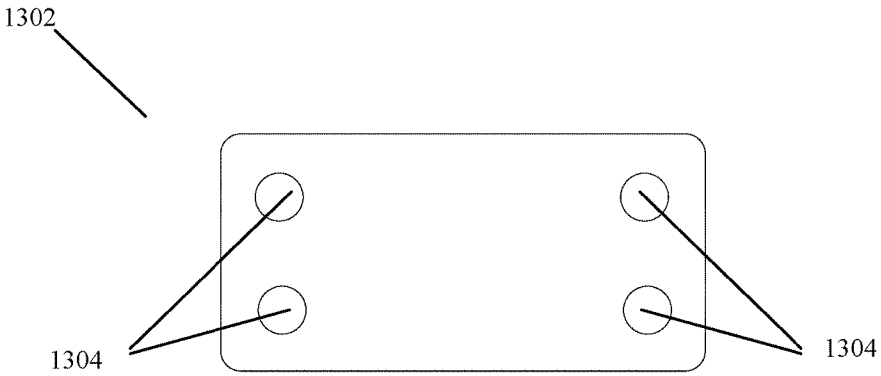
FIG. 13 is a top view of a support mounting plate.

FIG. 13 is a top view of a mounting support plate 1302. The preferred embodiment of the mounting support plate 1302 has mounting support plate mounting holes 1304 for affixing to the mounting support plate 1302 to LED sections 102. This mounting support plate 1302 may be used in conjunction with the U-bracket 1102 as described above to prevent the U-bracket 1102 from spreading, thus potentially causing LED sign failure, and allowing the LED sections 102 to separate. One skilled in the art may select materials including, but not limited to, ferrous and non-ferrous metal, carbon fiber, fiberglass, and plastic to construct the mounting support plate 1302. The mounting support plate 1302 is preferably coated with rust resistant materials to protect and prevent corrosion.

Figure 14:
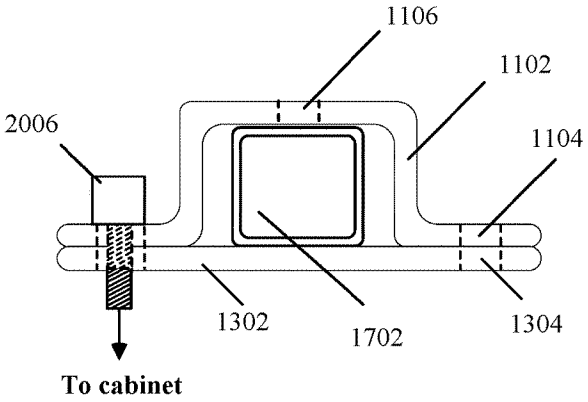
FIG. 14 an end view of a U-mounting bracket, a vertical support member and mounting plate in the mounting configuration.

FIG. 14 is an end view of a U-bracket 1102, a vertical support member 1702, mounting support plate 1302 and vertical bracket mounting fasteners 2006 in their installed positions. In this alternate embodiment, the vertical support member 1702 is sandwiched between a U-bracket 1102 and a mounting support plate 1302. As the vertical bracket mounting fasteners 2006 are tightened, the U-bracket 1102 and the mounting support plate 1302 capture the vertical support member 1702 to prevent slippage once the assembled sign 1902 is installed.

Figure 15:
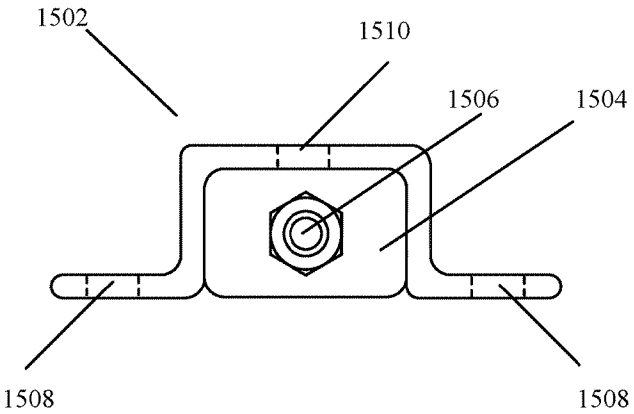
FIG. 15 is a side view of an end support mounting bracket and end plate.
Figure 16:
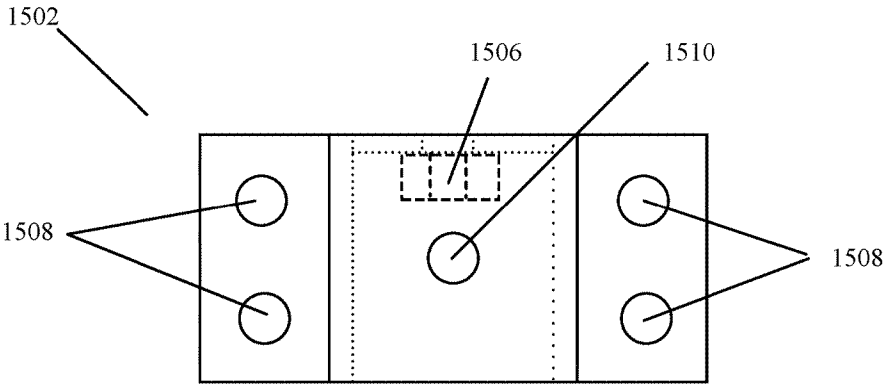
FIG. 16 is a top view of an end support mounting bracket.

FIGS. 15 and 16 are a side view and a top view of an end bracket 1502, respectively. An end bracket 1502 may comprise a U-bracket 1102, an end plate 1504, an end bracket fastener 1506, and end bracket mounting holes 1508. The end bracket support member mounting hole 1510 is in the same place as the U-bracket support member mounting hole 1106 for the U-bracket 1102. In the preferred embodiment, the end bracket 1502 is created by permanently affixing an end plate 1504 to the U-bracket 1102 described above. Additionally, an end bracket fastener 1506 is rigidly affixed to underside of the end plate 1504. In the preferred embodiment, the end plate 1504 is welded at the end of the U-bracket 1102 and a nut is welded on the underside end plate 1504. It would apparent to one skilled in the art of other methods for permanently affixing the end plate 1504 and end bracket fastener 1506 to the end bracket 1502. The end bracket 1502 has end bracket mounting holes 1508 on the flanges as seen above in the U-Bracket 1102 pictured in FIG. 11. Additionally, as with the U-bracket 1102, the end bracket 1502 has an end bracket support member mounting hole 1510 for affixing the end bracket 1502 to the vertical member 1702. The end bracket 1502 allows the LED section 102 to be rigidly affixed to both the vertical support member 1702 and to the horizontal support member 1802.

Figure 17:
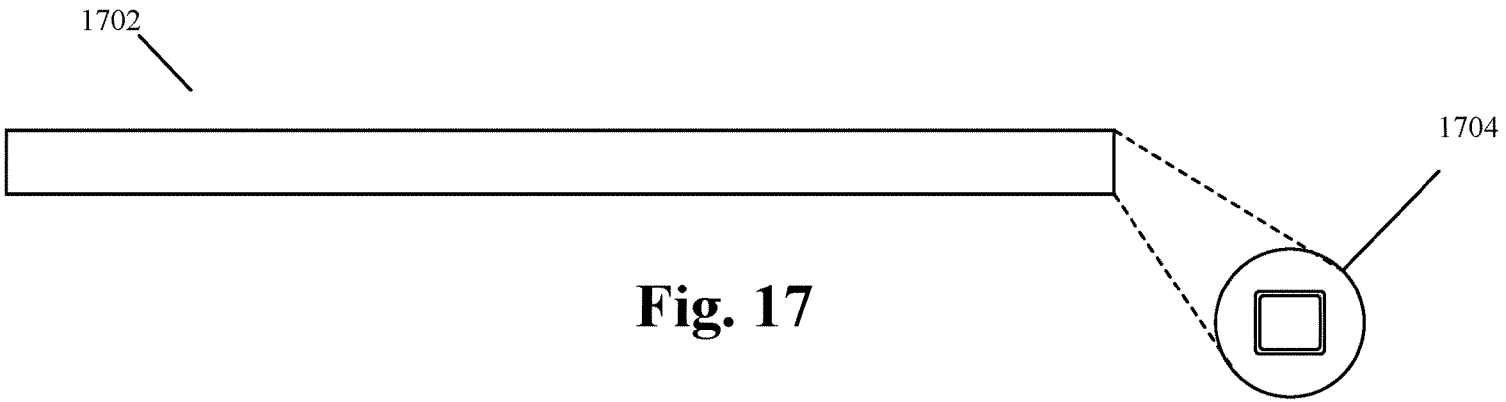
FIG. 17 is a side view of the vertical support member.

FIG. 17 is a side view of the vertical support member 1702. Shown in vertical support member end view 1704, the vertical support member 1702 is square tube-shaped profile. In the preferred embodiment, the vertical support member 1702 may be constructed from steel square tube stock 1704. The vertical support member 1702 may be constructed from other materials including, but not limited to, ferrous and non-ferrous metals, carbon fiber, plastic, and wood. One skilled in the art may chose different profiles for the vertical support member 1702 including, but not limited to, cylindrical, square, angled, and rectangular profiles. Additionally, the vertical support member 1702 may be fabricated from solid bar stock and tube stock. This vertical support member 1702 in cooperation with the U-brackets 1102 and end brackets 1502 provide a rigid structure for the assembled LED sign 1902.

Figure 18:
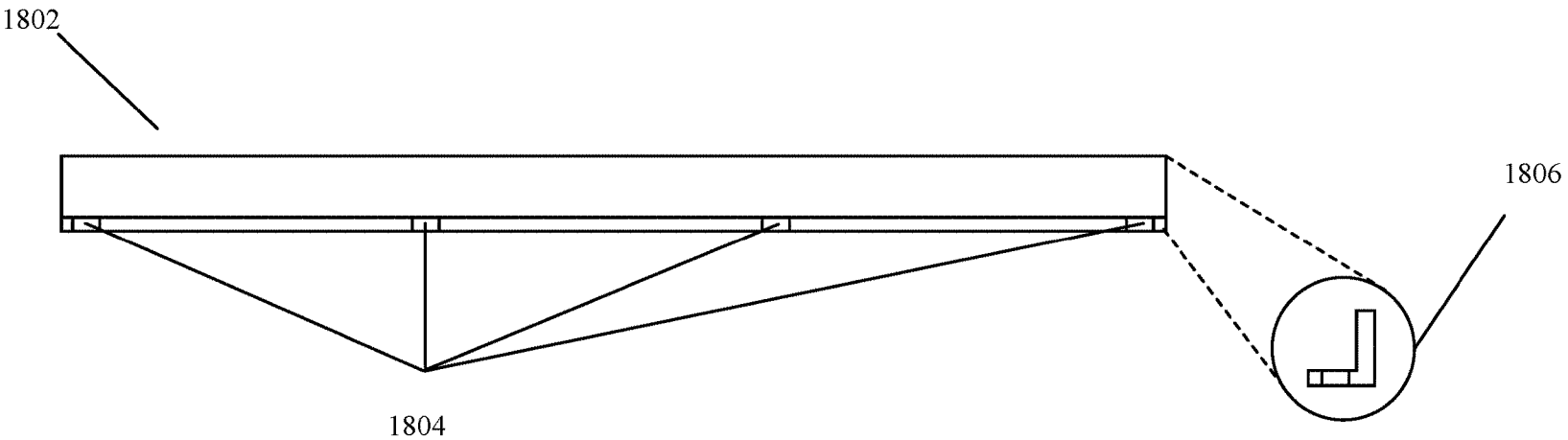
FIG. 18 is a view of the horizontal support member.

FIG. 18 is a view of the horizontal support member 1802. Shown in horizontal support member end view 1806, the horizontal support member 1802 is an L-shaped profile, commonly known as "angle iron." In the preferred embodiment, the horizontal support member 1802 may be constructed from angle iron with a L-shape profile 1806 where the customer may drill horizontal support member mounting holes 1804 at the desired spacing for a particular sign size to accommodate the protruding upper pins 106. The horizontal support member 1802 may be constructed from other materials including, but not limited to, ferrous and non-ferrous metals, carbon fiber, plastic, and wood. One skilled in the art may chose different profiles for the horizontal support member 1802 including, but not limited to, cylindrical, square, and rectangular profiles. This horizontal support member 1802 in cooperation with the end bracket 1502 provide a rigid structure for the assembled LED sign 1902. In the preferred embodiment, the assembled LED sign 1902 has a horizontal support member 1802 at the top and bottom but one skilled in the art may place horizontal support members 1802 where other U-brackets 1102 are placed horizontally in series, typically mid-way through the assembled LED sign 1902. The top and bottom horizontal support members 1802 engage end brackets 1502 which further engage the vertical support member 1702 to further increase the rigidity of the support structure.

Figure 19:
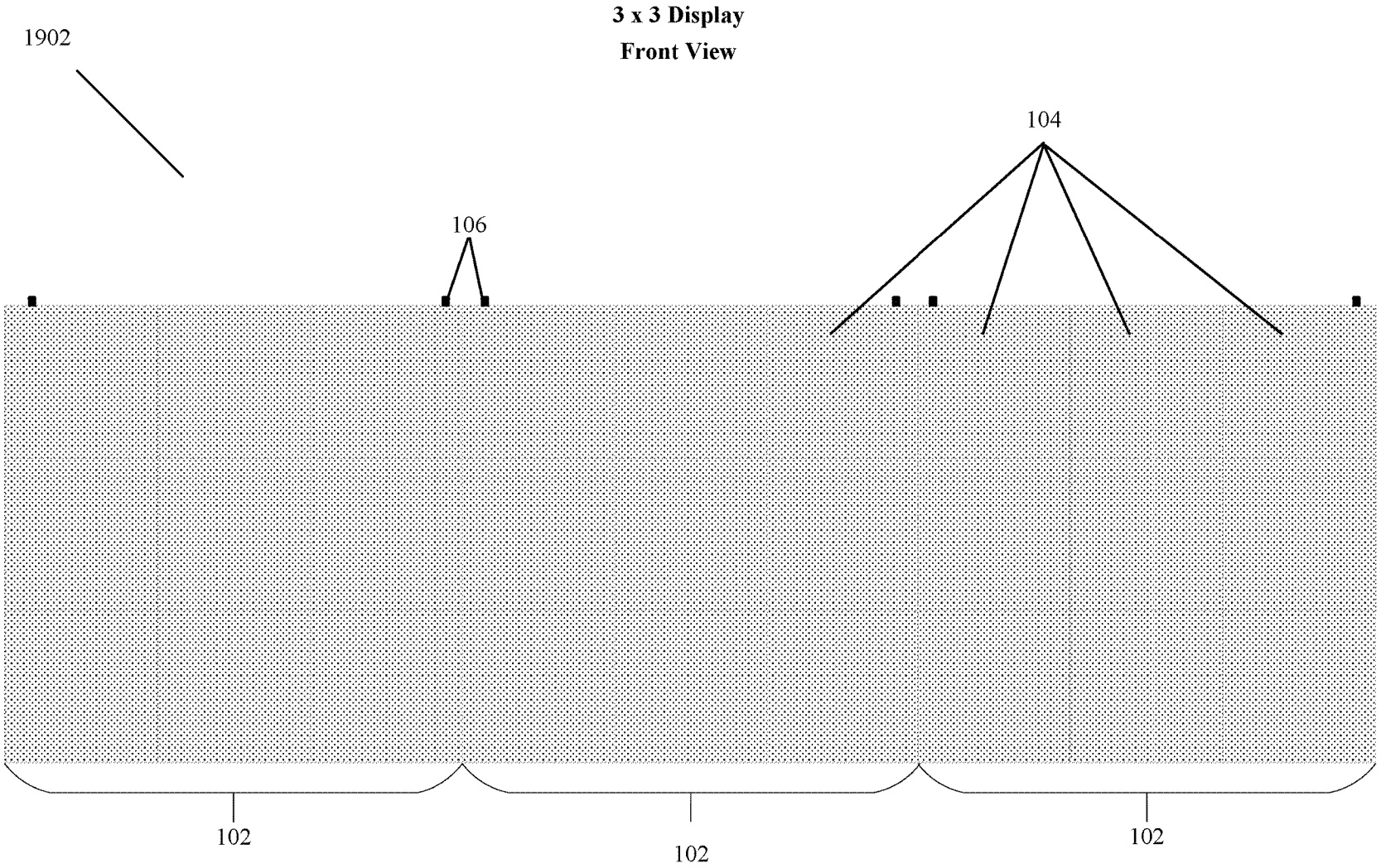
FIG. 19 is a front view of an assembled LED display.

FIG. 19 is a front view of a three by three assembled LED sign 1902 (three LED panels 104 high by nine LED panels 104 wide). In this exemplar, nine individual, one by three LED sections 102 interlocked together to form a large single assembled LED sign 1902. One skilled in the art may assemble various-sized signs that may be greater or smaller than this exemplar. In the preferred embodiment a customer would decide the overall horizontal length needed for the LED sign then select the appropriate size and number of panels of LED sections 102 to create the desired width of the sign. The customer would take the first LED section 102 place another LED section 102 adjacent and then engage the side alignment pins 108 to align the LED section 102 and actuate the left-side hook lock 606 to pull the LED sections 102 together and secure the LED sections 102 together. The customer would then install another LED Section 102 on top of the horizontal section engaging the upper alignment pins 106. This process is continued until the desired height and width of the LED sign is reached.

Figure 20:
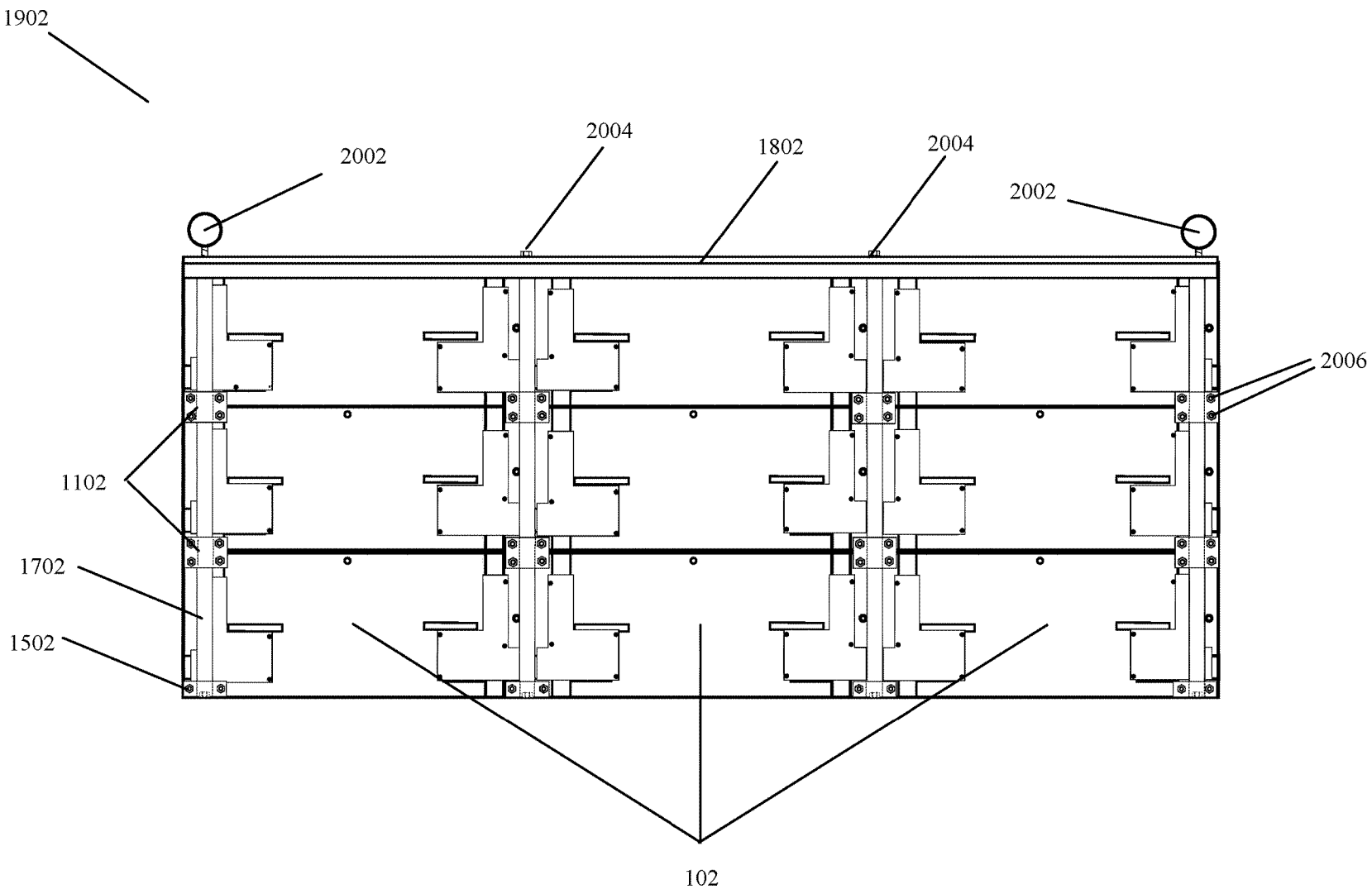
FIG. 20 is a rear view of an assembled LED display with the channel covers and support structure installed.

FIG. 20 is a rear view of the three by three assembled LED sign 1902 (three LED panels 104 high by nine LED panels 104 wide) illustrating the placement of the channel covers and the horizontal and vertical support structure. As described in FIG. 19 the LED sections 102 have been assembled and placed in their desired location to create the desired height and width of the assembled LED sign 1902. This rear view shows the attachment and placement of the support members to provide a rigid structure for the assembled LED sign 1902. FIGS. 11, 12, 13 show the mounting brackets and top plates that are used to secure the vertical and horizontal support members 1702 and 1802, respectively, to the assembled LED sign 1902. FIG. 14 as described earlier, illustrates how the mounting support plate 1302 and the U-bracket 1102 interact with the vertical support member 1702. This view illustrates, placement of the vertical support member 1702, the horizontal support member 1802 and the U-bracket 1102, the mounting support plate 1302 and the end bracket 1502.

In this preferred embodiment, there are four vertical support members 1702 and horizontal support members 1802. The bottom horizontal support member 1802 is removed for illustration. The vertical support member 1702 has two positions based on where they are located on the assembled LED sign 1902. If the vertical support member 1702 is on the interior of the sign, then its placement is such that it straddles four LED sections 102. The U-bracket 1102 in conjunction with the mounting support plate 1302 are affixed to each one of the four LED Sections 102 at a single point in the corner wherein a vertical bracket mounting fastener 2006 is installed. Socketed-head cap screw is preferably used to secure the vertical support structure.

Additionally depicted, are the horizontal bracket fasteners 2004 and the eye fasteners 2002. In the preferred embodiment, horizontal bracket fasteners 2004 are used to mount the horizontal support member 1802. However, the end horizontal bracket fasteners 2004 may be replaced with eye fasteners 2002 and used to lift the assembled LED sign 1902 in the desired position.

Figure 22:
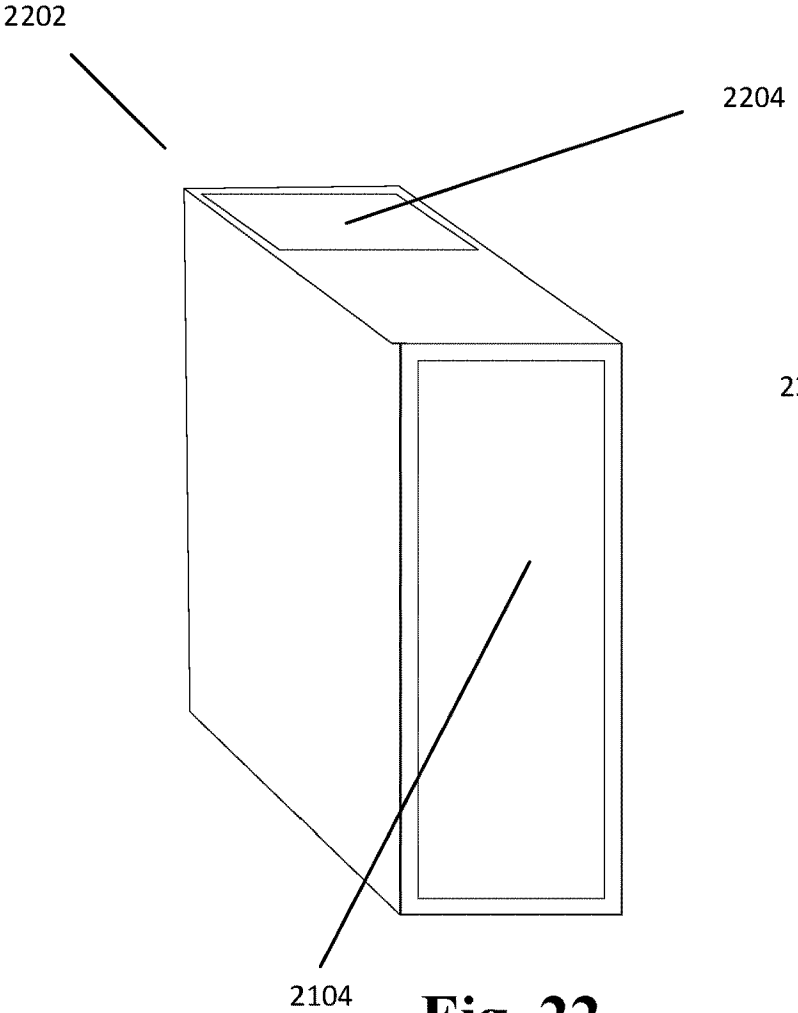
FIG. 22 is perspective view of a shock absorber end with parts compartment.
Figure 21:
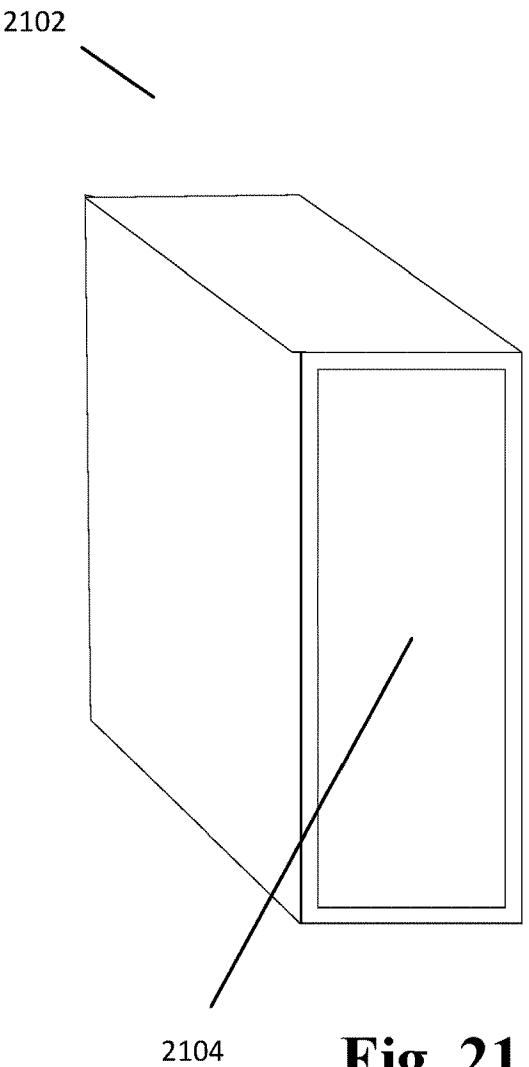
FIG. 21 is perspective view of a shock absorber end without parts compartment.

FIG. 21 and FIG. 22 relate to packaging LED sections 102 for shipping and are perspective views of shock absorber ends 2102, 2202. In this preferred embodiment, a shock absorber end 2102 is rectangular in shape with an internal portion of the rectangle removed to create a shock absorber cabinet cavity 2104. The depth of the shock absorber cabinet cavity 2104 may be determined by the size and weight of the LED section 102 to be protected from damage during storage and shipping. Shock absorber end 2202 is similar to the shock absorber end 2102 with one exception, shock absorber end 2202 defines an additional compartment 2204 that houses the power and data cables 2402, 2404, and end brackets 1502, 1102 during storage and shipping. Additionally, any tools supplied by one skilled in the art may be inserted into the compartment 2204 for storage and shipping. The material to construct the shock absorber ends 2102, 2202 may be selected from paper, cardboard, thermosplastics, expanding foam, biofoam, and polystyrene foam. The shock absorber ends 2102, 2202 may be selected from molded and non-molded material. In the preferred embodiment, a low-density polyethylene material is used to form the shock absorber ends 2102, 2202. One skilled in the art may select other types of shock absorbing material to protect the LED sections 102.

Figure 23:
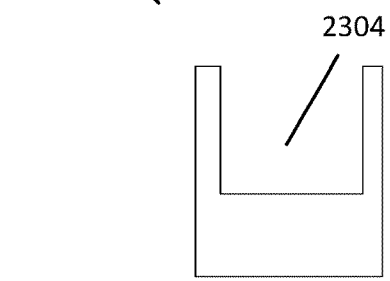
FIG. 23 is end view a mid-section shock absorber.

FIG. 23 is an end view of a mid-section shock absorber 2302. A mid-section shock absorber 2302 may have an overall rectangular shape with a U-shaped profile. The U-shape creates cabinet support 2304 within the mid-section shock absorber 2302 where shock absorber material resides between the LED section 102 and the top and bottom of the box 2502. Additionally, the vertically legs of the U-shape mid-section shock absorber 2302 provides shock absorption between the side of the box 2502 and the LED section 102. The material to construct the mid-section shock absorber 2302 may be selected from paper, cardboard, thermosplastics, expanding foam, biofoam, and polystyrene foam. As described above for the shock absorber ends 2102, 2202, the mid-section shock absorber 2302 may be preferably be constructed from the same low-density polyethylene material. The shock absorber 2302 may be selected from molded and non-molded material. One skilled in the art may select other types of shock absorbing material to protect the LED sections 102. Additionally, in this preferred embodiment, the set of shock absorbers 2102, 2202, 2302 are constructed from the same low-density polyethylene material. However, one skilled in the art may choose to use the same type of shock absorbing material or they may use a combination of different materials thereof.

Figure 24:
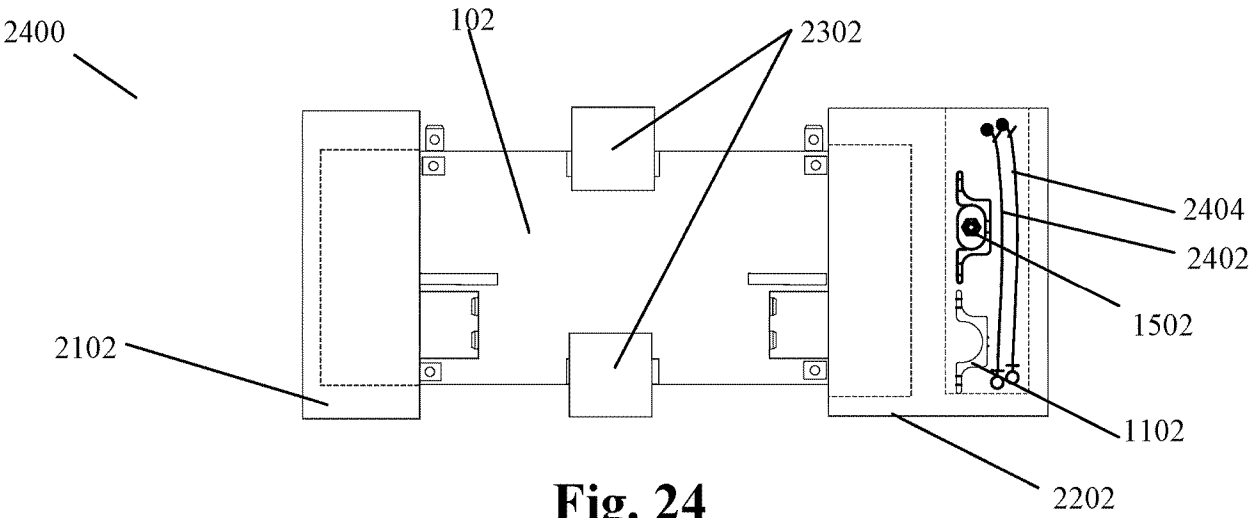
FIG. 24 is side view with a cabinet with the shock absorbers installed.

FIG. 24 is a side view of an LED section 102 with shock absorbers 2102, 2202, 2302 installed in their preferred placement. In the preferred embodiment, a shock absorber end 2102 and a shock absorber end 2202 may be placed on each end of the LED section 102. Additionally, the side view illustrates the compartment 2204 housing a power cable 2402, a data cable 2404, U-brackets 1102 and end brackets 1502 during storage and shipping. A mid-section shock absorber 2302 may be placed on the cabinet 202 top and cabinet 202 bottom mid-way between the end shock absorbers 2102, 2202. This placement provides equal support along the top and bottom of the box 2502.

Figure 25:
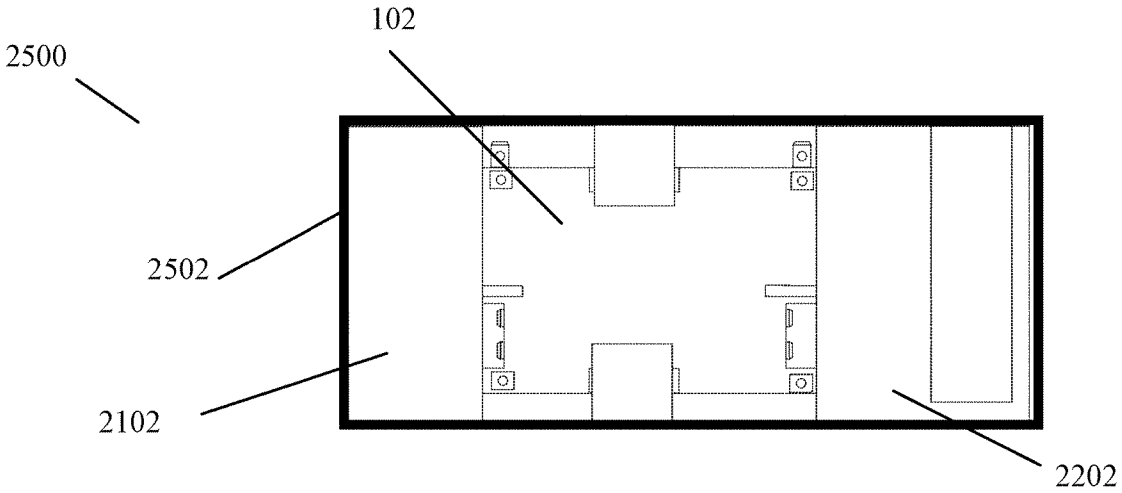
FIG. 25 is a side view of an LED section stored inside a box.

FIG. 25 is a side view of an LED section 102 packaged inside a box 2502. The shock absorbers 2102, 2202, 2302 surrounding the LED section 102 fit snuggly inside the box 2502 to prevent shifting during transit. Additionally, there is space between the LED section 102 and the box 2502, where some of the space may be filled by the shock absorbers and the remaining space filled with air. In this shipping configuration, minor incursions into the box 2502 and damage to the box 2502 may be tolerated without damage to the LED section 102. In the preferred embodiment the box 2502 may be constructed cardboard but one skilled in the art may select other material including, but not limited to, plastic and fiberboard for the box 2502 based on availability and suitability to protect the LED section 102.

Having thus described the invention, I claim:

1. A rapidly-deployable, configurable, modular light emitting diode sign system comprising:

a. more than one modular rigid cabinet defining a cavity therein for receiving system components, each cabinet having—
   i. a front opening with releasable fasteners,
   ii. a plurality of locks on at least two sides of each cabinet cooperatively engaging the reciprocal locks on the opposing side of the at least one adjacent cabinet,
   iii. a power supply,
   iv. a cooler,
   v. a power cable,
   vi. a data cable bundle,
   vii. at least one cable channel defined in a back side of in each and sized to receive cables,
   viii. a cover removably covering the cable channel,
   ix. a system controller having—
      1. a video display section transmitting at least one stored video program,
      2. a communication controller receiving, displaying, and transmitting at least one video program, and
      3. a memory section for storing firmware and at least one video display program, and
   x. at least one fastener for affixing the cabinet to a support member; and b. at least one light emitting diode panel covering the front opening and removably engaging each of the fasteners and receiving communication from the controller regarding messages to be displayed, whereby a sign of a specified size is created by mulling a number of cabinets with minimal tools and little or no additional parts, and without the need to modify the displays onsite to mull them together, and upon mulling, forming a single, seamless display having the combined size of all the cabinets mulled together, the installer affixing the assembled interlocked modular display system to a support in a desired location and programming the controllers to display at least one video program.

2. The system of claim 1, where the cabinet is waterproof.

3. The system of claim 1, where at least one alignment device on at least one side of each cabinet, the device selected from intercooperating pins and sockets, tongue and groove, rails, retainers, and tabs and slots.

4. The system of claim 1, where the cooler is selected from louvers, a fan, air conditioning, a heat sink, and a heat exchanger.

5. The system of claim 1, where the cooler is centralized in a single location and provides cooling to the individual LED cabinets.

6. The system of claim 1, where the power supply is centralized in a single location and provides power to the individual LED cabinets.

7. The system of claim 1, where the system controller is selected from a system on a chip, microprocessor, a microcontroller, and a programmable logic controller.

8. The system of claim 1, where the system controller is wired or wireless.

9. The system of claim 1, where the controller is programmed remotely.

10. The system of claim 1, where the system controller and communications controller are integrated into a single controller.

11. The system of claim 1, where the data cable is waterproof.

12. The system of claim 1, where the data cable includes a quick-connector.

13. The system of claim 1, where the power cable is waterproof.

14. The system of claim 1, where the power connector is a quick-connector.

15. The system of claim 1, where the fastener connecting the light emitting diode panel is selected from screws, bolts, nuts, latches, keys, pins, clips, cam connectors, and cam lock.

16. The system of claim 15, where a lock release activating each fastener is accessed by passing a specialized tool through a small access hole on a face of the light emitting diode panel.

17. The system of claim 1, the lock incorporating a cam that the securely engages to adjoin cabinets.

18. A rapidly-deployable, configurable, modular light emitting diode sign system comprising:

a. more than one modular rigid cabinet defining a cavity therein for receiving system components, each cabinet having—
   i. a front opening with releasable fasteners,
   ii. a plurality of locks on at two sides of each cabinet cooperatively engaging the reciprocal locks on the opposing side of the at least one adjacent cabinet,
   iii. a power supply,
   iv. a cooler,
   v. a power cable,
   vi. a data cable bundle,
   vii. at least one cable channel defined in a back side of in each and sized to receive cables,
   viii. a cover removably covering the cable channel,
   ix. a system controller having—
      1. a video display section transmitting at least one stored video program,
      2. a communication controller receiving, displaying, and transmitting at least one video program, and
      3. a memory section for storing firmware and at least one video display program, and
   x. at least one fastener for affixing the cabinet to a support member;

b. at least one light emitting diode panel covering the front opening and removably engaging each of the fasteners and receiving communication from the controller regarding messages to be displayed, and;

c. a shipping package system having—
   i. at least one boxed sized to receive a display and system components,
   ii. a plurality of shock absorbers sized to snugly fit inside the box protecting the display and system components from damage during shipment, whereby each cabinet with needed components are shipped in the same box so that an installer desiring to create a sign of a specified size by mulling together a number of cabinets, receives the needed number of boxed cabinets, removes them, assembles them using the equipment in the same box as the cabinet, with minimal tools and little or no additional parts, and without the need to modify the displays onsite to mull them together, and upon mulling forming a single, seamless display having the combined size of all the cabinets mulled together, the installer affixing the assembled interlocked modular display system to a support in a desired location and programming the controllers to display at least one video program.

19. The system of claim 18, where the box is selected from plastic and fiberboard.

20. The system of claim 18, where the shock absorbers is selected from molded and non-molded material.

* * * * *